US011260497B2

(12) United States Patent
Watanabe

(10) Patent No.: US 11,260,497 B2
(45) Date of Patent: Mar. 1, 2022

(54) POLISHING APPARATUS AND POLISHING PAD

(71) Applicant: TOSHIBA MEMORY CORPORATION, Minato-ku (JP)

(72) Inventor: Takashi Watanabe, Yokkaichi (JP)

(73) Assignee: TOSHIBA MEMORY CORPORATION, Minato-ku (JP)

( * ) Notice: Subject to any disclaimer, the term of this patent is extended or adjusted under 35 U.S.C. 154(b) by 371 days.

(21) Appl. No.: 16/271,914

(22) Filed: Feb. 11, 2019

(65) Prior Publication Data

US 2019/0344398 A1 Nov. 14, 2019

(30) Foreign Application Priority Data

May 11, 2018 (JP) ..... JP2018-092434

(51) Int. Cl.
*B24B 37/013* (2012.01)

(52) U.S. Cl.
CPC ..... *B24B 37/013* (2013.01)

(58) Field of Classification Search
CPC ... B24B 37/013; B24B 37/042; B24B 37/005; B24B 37/04; B24B 49/04; B24B 49/12; H01L 22/26
USPC ..... 451/5, 6, 8, 41
See application file for complete search history.

(56) References Cited

U.S. PATENT DOCUMENTS 5,413,941 A 5/1995 Koos et al.
6,142,855 A * 11/2000 Nyui ..... B24B 37/013 356/630
6,146,242 A 11/2000 Treur et al.
6,429,130 B1 8/2002 Chuang
6,679,756 B2 * 1/2004 Ishikawa ..... B24B 37/013 257/E21.23
6,690,473 B1 * 2/2004 Stanke ..... B24B 37/34 257/E21.53
6,911,662 B2 * 6/2005 Kim ..... B24D 7/12 250/559.27
6,916,225 B2 * 7/2005 Sugiyama ..... B24B 37/013 451/285
7,235,154 B2 6/2007 Dalrymple et al.
8,045,142 B2 * 10/2011 Kimba ..... G01N 21/211 356/72

(Continued)

FOREIGN PATENT DOCUMENTS

JP 11-198033 7/1999
JP 3109577 11/2000

(Continued)

*Primary Examiner* — Orlando E Aviles
*Assistant Examiner* — Robert F Neibaur
(74) *Attorney, Agent, or Firm* — Oblon, McClelland, Maier & Neustadt, L.L.P.

(57) ABSTRACT

A polishing apparatus includes a holder holding a target. A polisher polishes the target. An irradiator irradiates the target with an irradiation light from below the polisher. A photoreceiver receives a reflection light reflected from the polishing target to detect a relation between a wavelength and a light quantity of the reflection light. A first reflector bends the irradiation light from the irradiator in a direction tilted to the polishing target. A second reflector bends the reflection light from the polishing target to the photoreceiver. The first reflector irradiates the polishing target with the irradiation light in a direction tilted to the polishing target.

9 Claims, 17 Drawing Sheets

(56) References Cited

U.S. PATENT DOCUMENTS

| | | | | |
|---|---|---|---|---|
| 8,115,912 | B2 | 2/2012 | Kimba | |
| 9,011,202 | B2 | 4/2015 | David | |
| 10,565,701 | B2 * | 2/2020 | Benvegnu | B24B 37/013 |
| 10,831,109 | B2 * | 11/2020 | Jak | G03F 7/70241 |
| 2002/0013007 | A1 | 1/2002 | Hasegawa et al. | |
| 2002/0191197 | A1 | 12/2002 | Bibby, Jr. et al. | |
| 2003/0207651 | A1 * | 11/2003 | Kim | B24B 49/12 451/6 |
| 2007/0042675 | A1 | 2/2007 | Benvegnu et al. | |
| 2008/0242195 | A1 | 10/2008 | Heinrich et al. | |

FOREIGN PATENT DOCUMENTS

| | | |
|---|---|---|
| JP | 2002-009030 | 1/2002 |
| JP | 2005-294365 | 10/2005 |
| JP | 2005-340679 | 12/2005 |
| JP | 2007-518279 | 7/2007 |
| JP | 2009-142969 | 7/2009 |
| JP | 2009-196002 | 9/2009 |
| JP | 6234438 | 11/2017 |
| WO | WO 2007/024807 A2 | 3/2007 |

* cited by examiner

FIG. 1
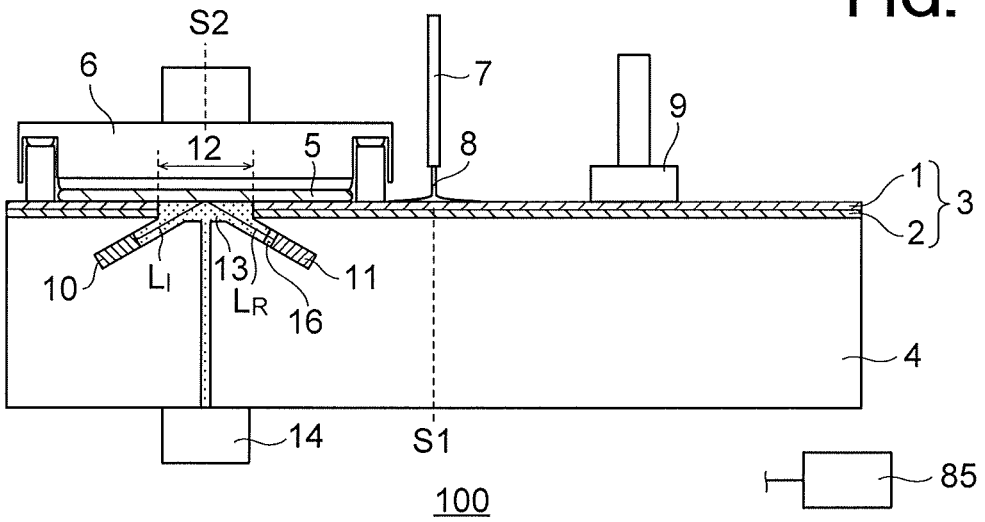
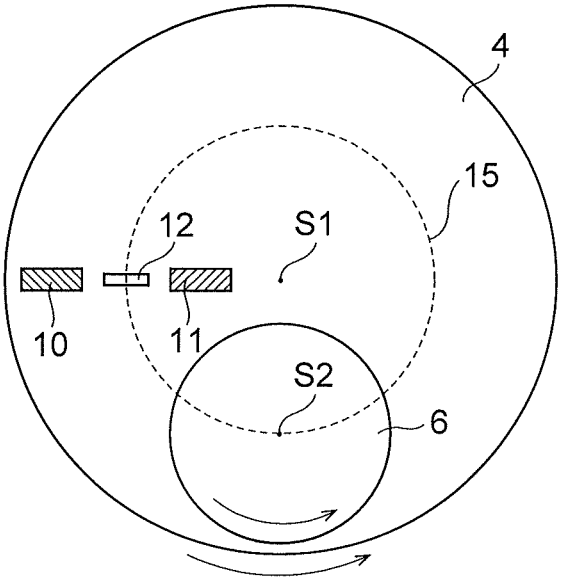
FIG. 2
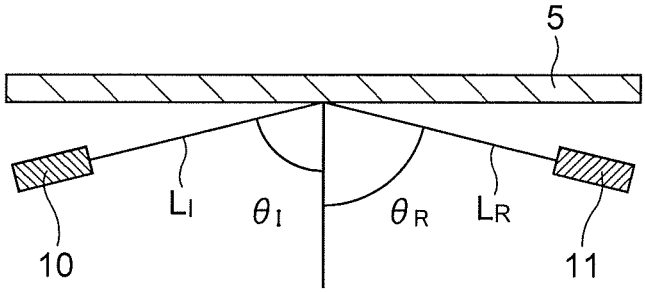
FIG. 3

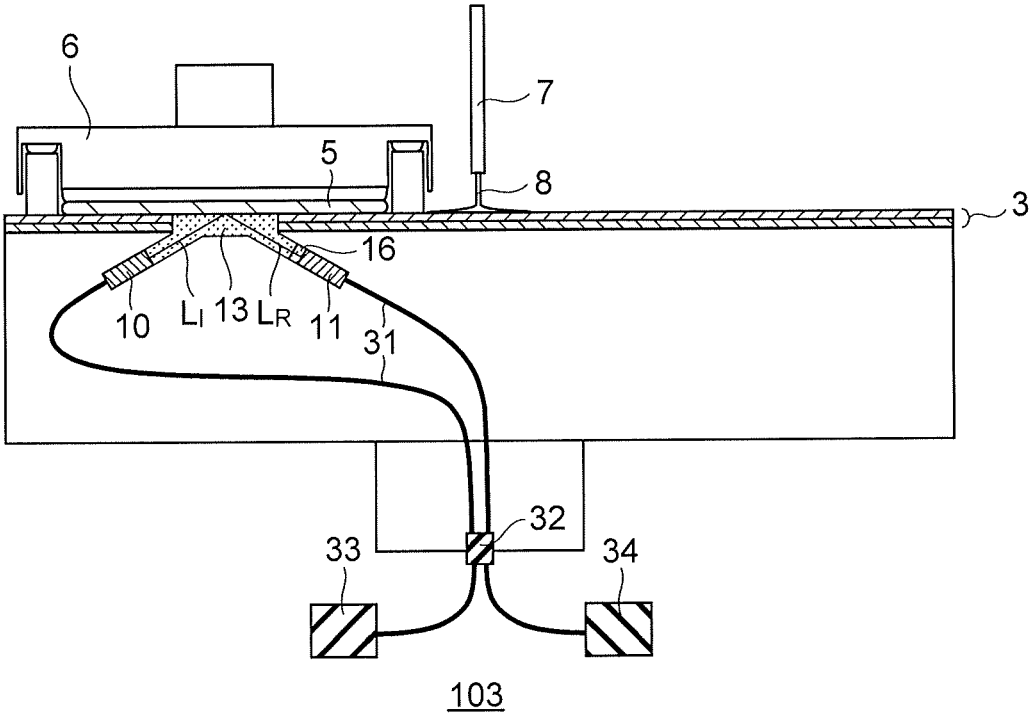
FIG. 12
FIG. 13A
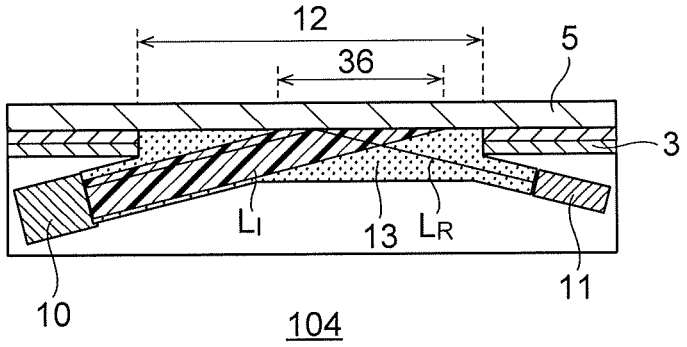
FIG. 13B
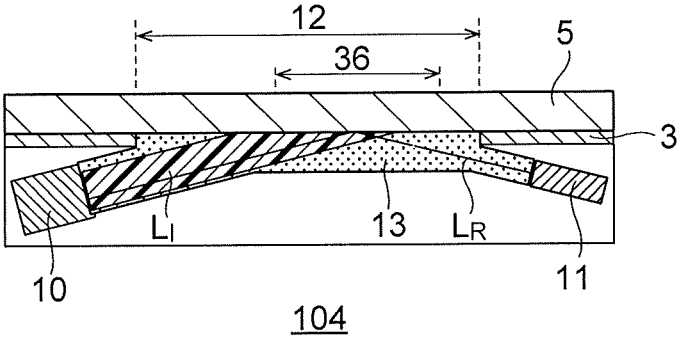

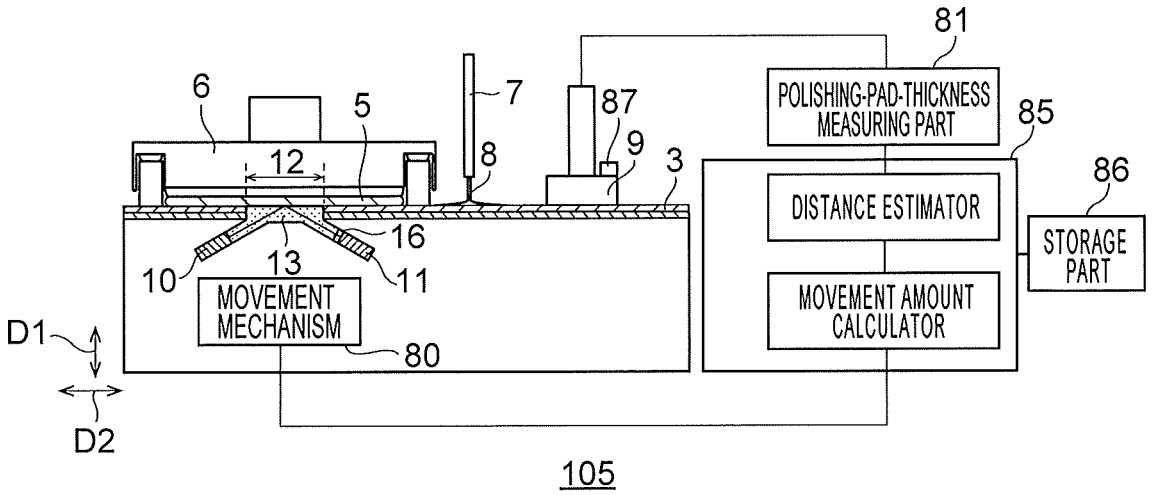
FIG. 14
FIG. 15A
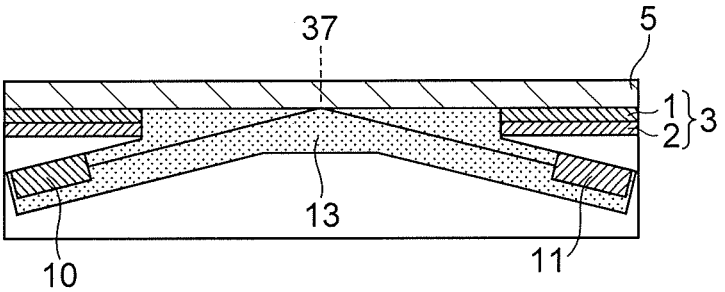
FIG. 15B
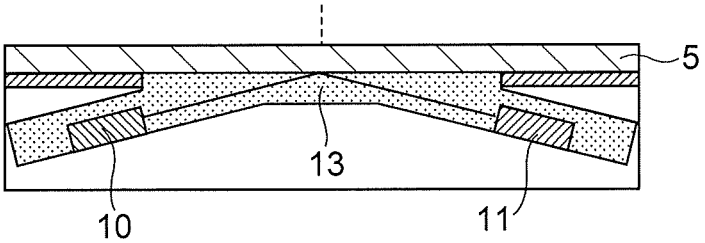
FIG. 15C
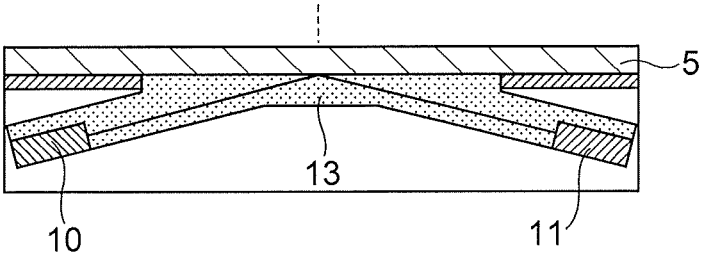

POLISHING APPARATUS AND POLISHING PAD

CROSS REFERENCE TO RELATED APPLICATIONS

This application is based upon and claims the benefit of priority from the prior Japanese Patent Application No. 2018-092434, filed on May 11, 2018, the entire contents of which are incorporated herein by reference.

FIELD

The embodiments of the present invention relate to a polishing apparatus and a polishing pad.

BACKGROUND

At a CMP (Chemical Mechanical Polishing) step in a semiconductor manufacturing process, detection of a polishing end point is performed while the residual film thickness of a polishing target film on a substrate is measured. In order to measure the film thickness, the polishing target film is irradiated with a white light and the spectrum of a reflection light is analyzed to measure the film thickness of the polishing target film.

In a conventional end point detection, the white light passes water or slurry through a hole or a transparent window provided in advance on a polishing pad to reach the surface of the substrate. An irradiator of the white light and a photoreceiver of the reflection light are normally close to each other and the substrate is irradiated with the white light substantially perpendicularly.

However, when the polishing target film is a silicon dioxide film, the reflection light from an interface between the surface of the polishing target film and water is significantly weak because the refractive index of the silicon dioxide film and that of water are close. In this case, reflection from a material film of a lower layer than the polishing target film may be more intense than the reflection light from the surface of the polishing target film, which prevents accurate measurement of the film thickness of the polishing target film. For example, in a manufacturing process of a three-dimensional memory cell array, there are many stacked films under a polishing target film and it is thus difficult to measure the film thickness of the polishing target film.

BRIEF DESCRIPTION OF THE DRAWINGS

FIG. 1 is a schematic sectional view illustrating a configuration example of a polishing apparatus according to a first embodiment;

FIG. 2 is a schematic plan view illustrating a location relation among the polishing table, the polishing head, the irradiator, the photoreceiver, and the opening;

FIG. 3 is a conceptual diagram illustrating a location relation among the semiconductor substrate, the irradiator, and the photoreceiver;

FIG. 12 is a schematic sectional view illustrating a configuration example of a polishing apparatus according to a third embodiment FIGS. 13A and 13B are schematic sectional views illustrating a configuration example of a polishing apparatus according to a fourth embodiment;

FIG. 14 is a schematic sectional view illustrating a configuration example of a polishing apparatus according to a fifth embodiment;

FIGS. 15A to 15C are schematic sectional views illustrating a movement method of the irradiator and the photoreceiver according to the fifth embodiment;

DETAILED DESCRIPTION

Figure 4:
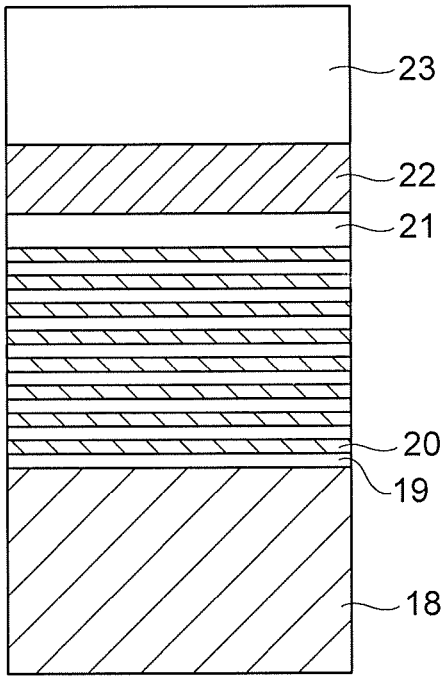
FIG. 4 is a sectional view illustrating a configuration example of the semiconductor substrate.

Embodiments will now be explained with reference to the accompanying drawings. The present invention is not limited to the embodiments. In the present specification and the drawings, elements identical to those described in the foregoing drawings are denoted by like reference characters and detailed explanations thereof are omitted as appropriate.

A polishing apparatus according to an embodiment comprises a holder that holds a polishing target. A polisher polishes the polishing target. An irradiator irradiates the polishing target with an irradiation light from below the polisher. A photoreceiver receives a reflection light reflected from the polishing target to detect a relation between a wavelength and a light quantity of the reflection light. A first reflector bends the irradiation light from the irradiator in a direction tilted to the polishing target. A second reflector bends the reflection light from the polishing target to the photoreceiver. The first reflector irradiates the polishing target with the irradiation light in a direction tilted to the polishing target.

The irradiator irradiates the polishing target with the irradiation light in a direction tilted to a polishing face of the polishing target to enable a first light quantity of an S polarized light of a reflection light from a first face of the polishing target and a second light quantity of an S polarized light of a reflection light from a second face of the polishing target on an opposite side to the first face to exceed a third light quantity of S polarized lights of reflection lights from layers lower than the polishing target.

First Embodiment

FIG. 1 is a schematic sectional view illustrating a configuration example of a polishing apparatus according to a first embodiment. A polishing apparatus 100 includes a polishing pad 3, a polishing table 4, a polishing head 6, a slurry supply nozzle 7, a dresser mechanism 9, an irradiator 10, a photoreceiver 11, a polarization filter 16, and a computing part 85.

The polishing pad 3 includes a polishing layer 1 and a cushion layer 2 and is composed of these two layers. The polishing pad 3 is fixedly installed on the polishing table 4. The polishing pad 3 is configured to be rotatable on a central axis S1 along with the polishing table 4. The polishing pad 3 and the polishing table 4 serving as a rotational polisher rotate to polish the surface of a material film on the semiconductor substrate 5 (hereinafter, also simply "the surface of the semiconductor substrate 5") being a polishing target.

The polishing head 6 is configured to be rotatable on a central axis S2 in a state of holding a semiconductor substrate 5. The polishing head 6 rotates the semiconductor substrate 5 around the central axis S1 while pressing the semiconductor substrate 5 against the surface of the polishing pad 3. In this way, the polishing apparatus 100 polishes the surface of the semiconductor substrate 5 through the rotation of the polishing pad 3 and the rotation of the polishing head 6.

The slurry supply nozzle 7 supplies slurry 8 containing abrasive grains onto the surface of the polishing pad 3. The slurry 8 flows in between the polishing pad 3 and the semiconductor substrate 5 and polishes the surface of the semiconductor substrate 5. In this way, the polishing apparatus 100 polishes the surface of the semiconductor substrate 5 by rubbing the surface of the semiconductor substrate 5 against the polishing pad 3 while supplying the slurry 8.

The dresser mechanism 9 is provided to adjust the surface state of the polishing pad 3 during polishing or after polishing.

The irradiator 10 irradiates the semiconductor substrate 5 with an irradiation light $L_I$ from below the polishing pad 3. The irradiation light $L_I$ is, for example, a white light. The white light reaches the surface of the semiconductor substrate 5 through an opening 12 provided on the polishing pad 3 and is reflected from the surface of the semiconductor substrate 5 to become a reflection light $L_R$. The reflection light $L_R$ is received by the photoreceiver 11 through the opening 12. The photoreceiver 11 receives the reflection light $L_R$ from the semiconductor substrate 5 via the polarization filter 16 and detects a relation (a spectrum) between the wavelength and the light quantity of the reflection light $L_R$. The polarization filter 16 is an optical filter that transmits an S polarized light of the reflection light $L_R$ and blocks a P polarized light thereof. The polarization filter 16 can be placed at a freely-selected position on an optical path from the irradiator 10 to the photoreceiver 11. An optical path region 13 of the irradiation light $L_I$ and the reflection light $L_R$ is filled with pure water to prevent the slurry 8 from being mixed. The pure water is supplied from a pure water supplier 14 to the optical path region 13.

The polishing apparatus 100 causes the white light from the irradiator 10 to be incident on the surface of the semiconductor substrate 5 and analyzes the spectrum of the reflection light to measure the film thickness of the polishing target film provided on the surface of the semiconductor substrate 5. In the film thickness measurement, the computing part 85 is connected to be communicable with the photoreceiver 11 and measures the film thickness of the polishing target film with use of an interference between a reflection light from an interface of a front layer (first face) of the polishing target film and a reflection light from an interface of a back surface (second face) of the polishing target film. When a measured residual film thickness of the polishing target film becomes a predetermined value, the polishing apparatus 100 ends the polishing processing (detection of an end point). The film thickness measurement according to the present embodiment will be explained in more detail later.

FIG. 2 is a schematic plan view illustrating a location relation among the polishing table 4, the polishing head 6, the irradiator 10, the photoreceiver 11, and the opening 12. The polishing table 4 rotates on the central axis S1. The polishing head 6 rotates on the central axis S2 while holding the semiconductor substrate 5 and pressing the semiconductor substrate 5 against the polishing pad 3. The opening 12 provided on the polishing pad 3 is placed on a track 15 of a central part of the semiconductor substrate 5 held by the polishing head 6 and is formed in a slit shape. The irradiator 10 and the photoreceiver 11 are arranged substantially linearly on opposite sides of the opening 12, respectively.

FIG. 3 is a conceptual diagram illustrating a location relation among the semiconductor substrate 5, the irradiator 10, and the photoreceiver 11. The irradiation light $L_I$ from the irradiator 10 is incident on the surface of the semiconductor substrate 5 at a desired incidence angle $\theta_I$ and the reflection light $L_R$ reflected at a reflection angle $\theta_R$ being a substantially same angle as the incidence angle $\theta_I$ is received by the photoreceiver 11.

FIG. 4 is a sectional view illustrating a configuration example of the semiconductor substrate 5. For example, the semiconductor substrate 5 includes a silicon substrate 18, silicon dioxide films 19, 21, and 23, and silicon nitride films 20 and 22. The silicon dioxide film 19 is provided on the silicon substrate 18 and has a film thickness of about 40 nanometers. The silicon nitride film 20 is provided on the silicon dioxide film 19 and has a film thickness of about 40 nanometers. The silicon dioxide film 19 and the silicon nitride film 20 are repeatedly stacked one on the top of another and eight layers of the silicon dioxide film 19 and eight layers of the silicon nitride film 20 are stacked in FIG. 4. The silicon dioxide film 21 is provided on the stacked films of the silicon dioxide films 19 and the silicon nitride films 20. The film thickness of the silicon dioxide film 21 is about 100 nanometers. The silicon nitride film 22 is provided on the silicon dioxide film 21 and has a film thickness of about 200 nanometers. The silicon dioxide film 23 is provided on the silicon nitride film 22 and has a film thickness of about 400 nanometers. The silicon dioxide film 23 being a polishing target film is the topmost layer and the frontmost surface thereof is a polishing face (first face) to be polished. However, the structure of the semiconductor substrate 5 is not limited thereto.

The stacked body of the silicon dioxide films 19 and the silicon nitride films 20 and the silicon substrate 18 are placed under the silicon dioxide film 21. For example, in a manufacturing process of a three-dimensional memory cell array in which memory cells are arrayed three-dimensionally, many material films are often placed under the silicon dioxide film 23 being the polishing target film as in this example. In this case, if the irradiation light $L_I$ is caused to be incident on the polishing face of the silicon dioxide film 23 substantially perpendicularly thereto (that is, when the incidence angle is 0 degree), the light quantity of reflection lights from the lower-layer films 19 to 22 may be larger than that of a reflection light from the silicon dioxide film 23.

For example, it is assumed that a reflection light from an interface between pure water and the polishing face of the silicon dioxide film 23 is a first reflection light, a reflection light from an interface between the back surface of the silicon dioxide film 23 and the front surface of the silicon nitride film 22 is a second reflection light, a reflection light from an interface between the back surface of the silicon nitride film 22 and the front surface of the silicon dioxide film 21 is a third reflection light, and a reflection light from an interface between the back surface of the silicon dioxide film 21 and the front surface of the silicon nitride film 20 is a fourth reflection light. The back surface of the silicon dioxide film 23 is a face (second face) on the opposite side to the polishing face (first face) of the silicon dioxide film 23.

When the incidence angle is almost 0 degree in this example, the light quantity of the first reflection light is relatively small because a difference in the refractive index between water and a silicon dioxide film is relatively small. In contract thereto, a difference in the refractive index between a silicon dioxide film and a silicon nitride film is relatively large and therefore the light quantities of the second to fourth reflection lights are larger than that of the first reflection light. The film thickness of the silicon dioxide film 23 as the polishing target is measured based on changes in a reflectance spectrum produced by an interference between the first reflection light and the second reflection light. However, if the incidence angle is almost 0 degree, an interference between the second reflection light and the third or fourth reflection light is more intense than an interference between the first reflection light and the second reflection light, resulting in difficulty in detecting the end point with high accuracy.

In order to solve this problem, in the present embodiment, the irradiator 10 irradiates the surface of the semiconductor substrate 5 (the polishing face of the silicon dioxide film 23) with a white light in a direction tilted with respect thereto. While the following explanations are made assuming that the semiconductor substrate 5 has the structure illustrated in FIG. 4, illustrations of the silicon dioxide film 23 being the polishing target are omitted. Therefore, the polishing target may be referred to as "the semiconductor substrate 5".

Figure 5:
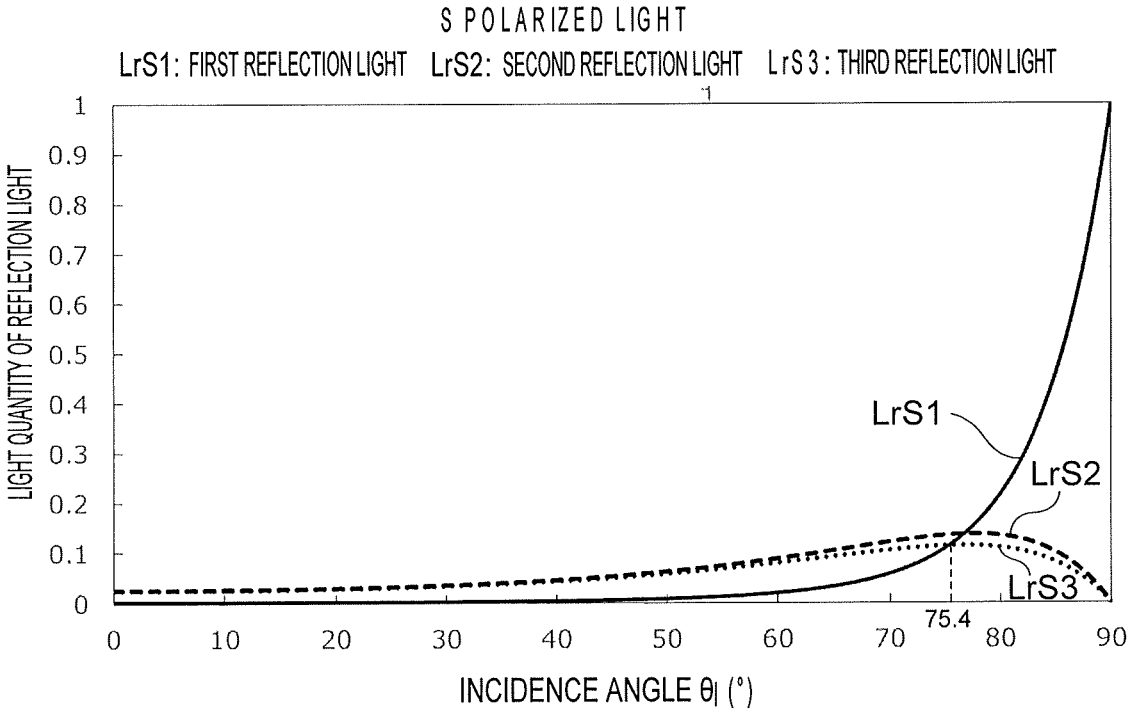
FIG. 5 is a graph illustrating relations between the light quantities of S polarized lights of the first to third reflection lights and the incidence angle of the irradiation light.
Figure 6:
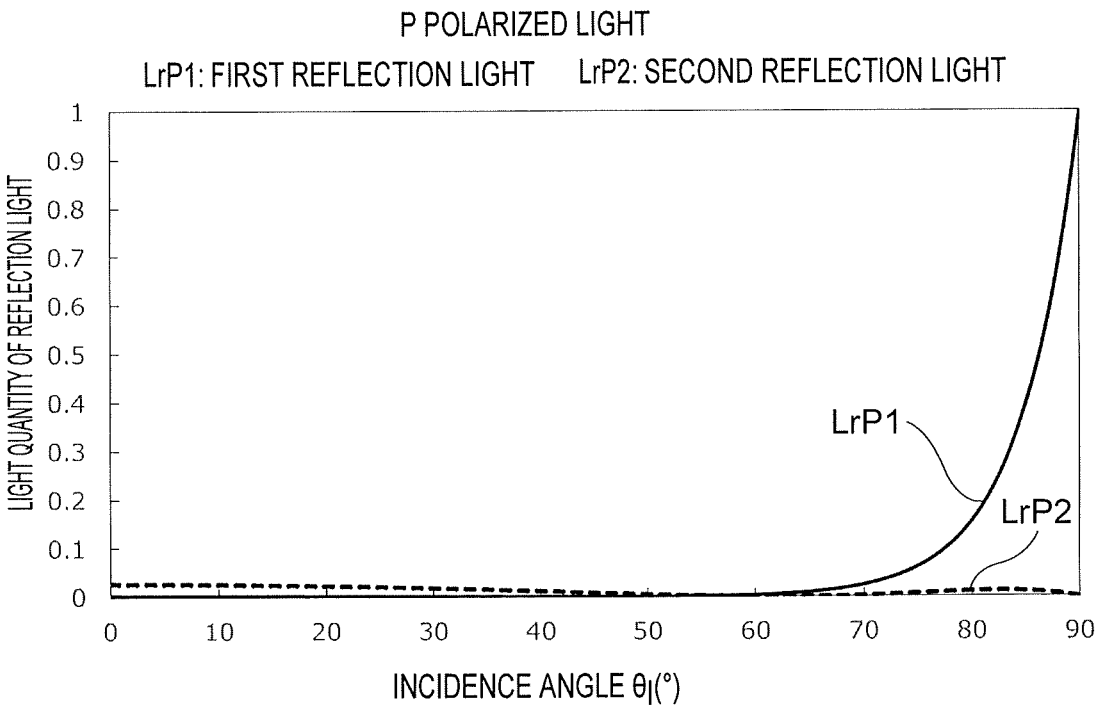
FIG. 6 is a graph illustrating relations between the light quantities of P polarized lights of the first and second reflection lights and the incidence angle of the irradiation light.

FIG. 5 is a graph illustrating relations between the light quantities of S polarized lights of the first to third reflection lights and the incidence angle of the irradiation light, respectively. FIG. 6 is a graph illustrating relations between the light quantities of P polarized lights of the first and second reflection lights and the incidence angle of the irradiation light, respectively. The horizontal axes of these graphs represent the incidence angle of the irradiation light. The vertical axes thereof represent the light quantities of the reflection lights. The light quantities of the reflection lights are represented as ratios to the light quantity of the irradiation light being assumed as 1.

As illustrated in FIG. 5, when the incidence angle $\theta_I$ is larger, the light quantity of a first reflection light LrS1 (the light quantity of an S polarized light) is larger. When the incidence angle $\theta_I$ is smaller than 75.4 degrees, the light quantity of the first reflection light LrS1 is below the light quantity of a third reflection light LrS3. However, when the incidence angle $\theta_I$ becomes equal to or larger than 75.4 degrees, the light quantity of the first reflection light LrS1 exceeds the light quantity of the third reflection light LrS3. Therefore, changes in the spectrum caused by an interference between the first reflection light LrS1 and a second reflection light LrS2 are larger than changes in the spectrum caused by an interference between the second reflection light LrS2 and the third reflection light LrS3. The light quantities of reflection lights from lower layers are smaller than the light quantity of the third reflection light LrS3. Therefore, the interference between the first reflection light LrS1 and the second reflection light LrS2 is the largest among interferences between the reflection lights from layers lower than the silicon nitride film 22. As a result, the film thickness of the silicon dioxide film 23 can be measured accurately and the accuracy in detection of the end point of the polishing processing can be improved.

With reference to the graph illustrated in FIG. 6, the light quantities of P polarized lights of reflection lights LrP1 and LrP2 become zero (0) at a point where the incidence angle $\theta_I$ becomes a Brewster's angle. When the incidence angle $\theta_I$ becomes larger, the light quantity of the P polarized light of the first reflection light LrP1 is increased while the light quantity of the P polarized light of the second reflection light LrP2 is considerably smaller than the S polarized light of the second reflection light LrP2. Therefore, the interference cannot be intensified by the first reflection light LrP1 and the second reflection light LrP2.

As described above, the graphs illustrated in FIGS. 5 and 6 indicate that it suffices to set the incidence angle $\theta_I$ to be equal or larger than about 75.4 degrees and to use the S polarized lights of reflection lights to cause reflection spectrum changes of the first reflection light LrS1 and the second reflection light LrS2 to be larger than those of other reflection lights. With the incidence angle $\theta_I$ set to be equal to or larger than about 75.4 degrees and use of the S polarized lights of reflection lights, the light quantity (first light quantity) of the first reflection light LrS1 and the light quantity (second light quantity) of the second reflection light LrS2 exceed the light quantity (third light quantity) of the S polarized lights of the reflection lights from layers lower than the silicon dioxide film 23. Accordingly, even when there are stacked films below the silicon dioxide film 23, the polishing apparatus 100 can accurately measure changes in the film thickness of the silicon dioxide film 23 and can improve the accuracy in the detection of the end point.

Figure 7:
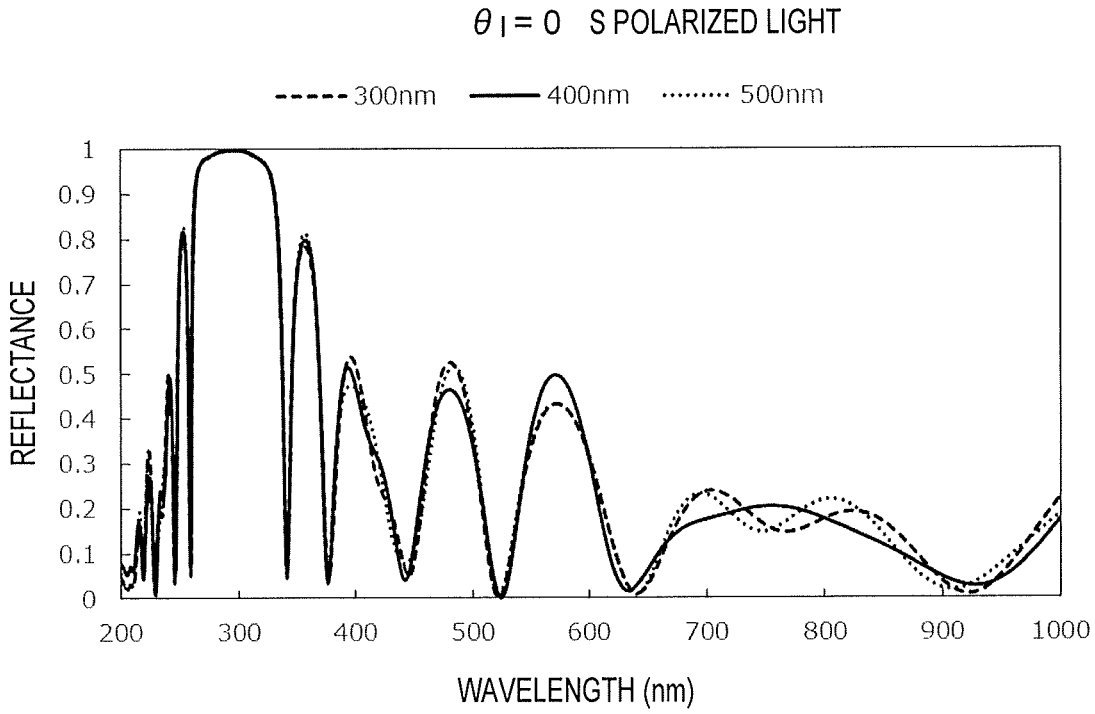
FIGS. 7 to 9 are graphs illustrating reflection spectra of a white light when the film thicknesses of the silicon dioxide film are 500 nanometers, 400 nanometers, and 300 nanometers, respectively.
Figure 8:
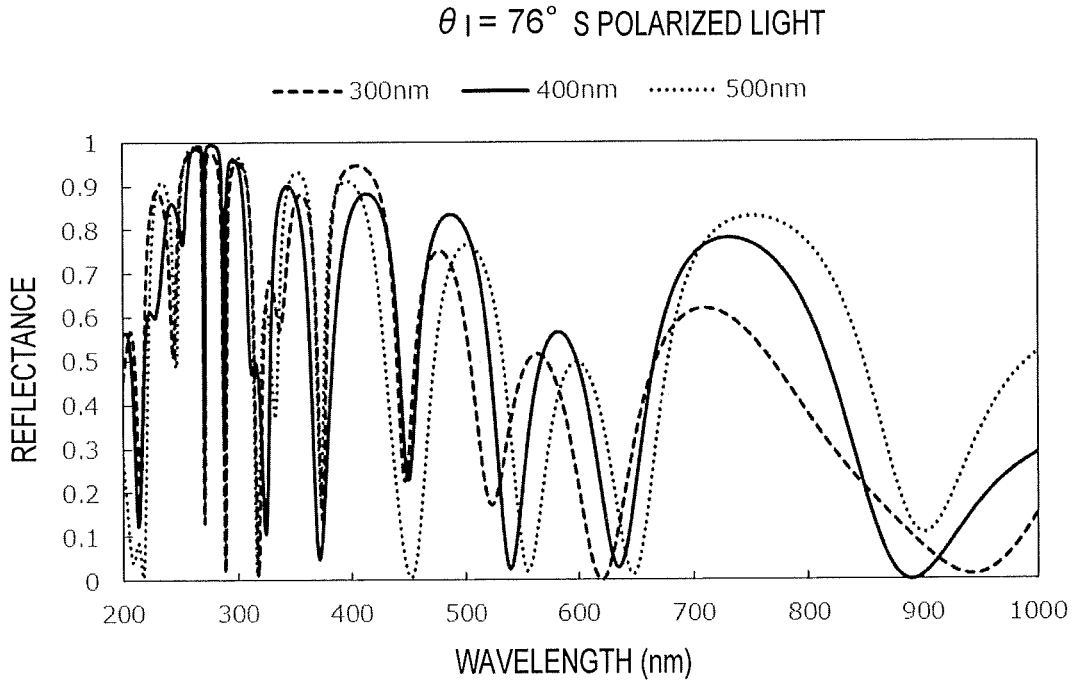
Figure 9:
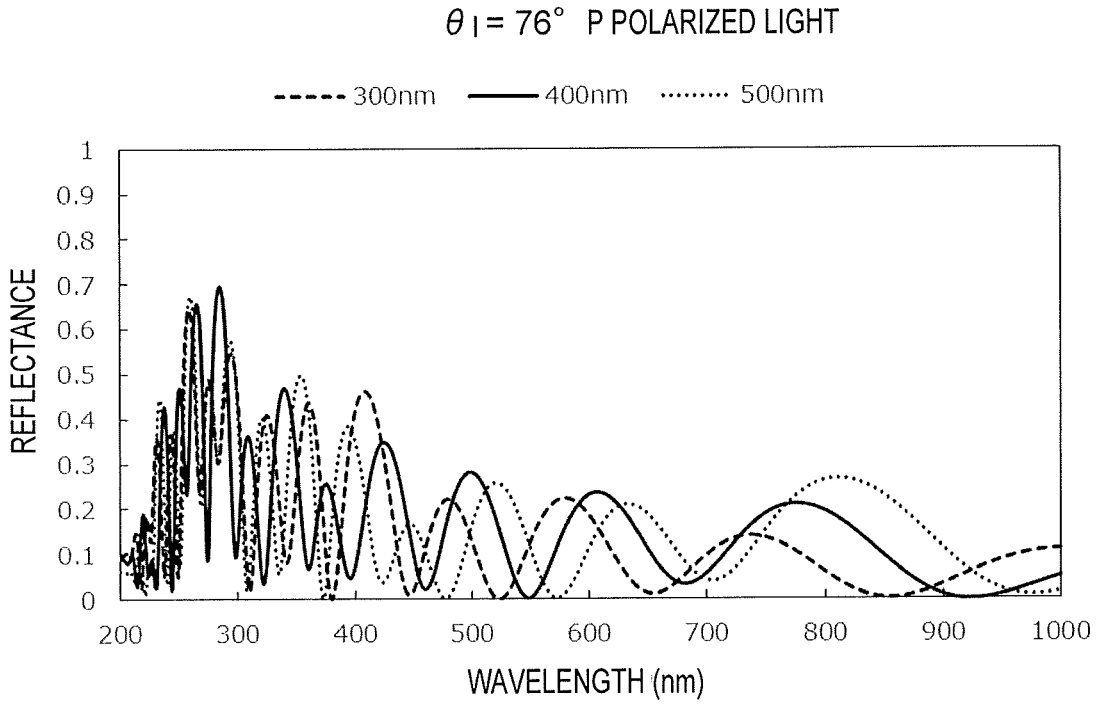

FIGS. 7 to 9 are graphs illustrating reflection spectra of a white light when the film thicknesses of the silicon dioxide film 23 are 500 nanometers, 400 nanometers, and 300 nanometers, respectively. FIG. 7 is a simulation result indicating reflection spectra of an S polarized light when the incidence angle $\theta_I$ is 0 degree (normal incidence). FIG. 8 is a simulation result indicating reflection spectra of an S polarized light when the incidence angle $\theta_I$ is 76.0 degrees. FIG. 9 is a simulation result indicating reflection spectra of a P polarized light when the incidence angle $\theta_I$ is 76.0 degrees. The horizontal axes represent the wavelength of the irradiation light $L_I$. The irradiation light $L_I$ is, for example, a white light and contains lights of a broad wavelength region. The vertical axes represent the ratio (reflectance) of a reflection light to the irradiation light having a light quantity of 1.

As illustrated in FIG. 7, when the incidence angle $\theta_I$ is 0 degree, the reflection spectrum does not change so much even if the film thickness of the silicon dioxide film 23 changes. In contrast thereto, when the incidence angle $\theta_I$ is 76.0 degrees, the reflection spectrum of the reflection light of an S polarized light greatly changes as illustrated in FIG. 8 if the film thickness of the silicon dioxide film 23 changes. As illustrated in FIG. 9, even when the incidence angle $\theta_I$ is 76.0 degrees, the overall reflectance of the reflection light of a P polarized light is lower than that of the reflection light of an S polarized light while changes in the reflection spectrum are large.

Figure 10:
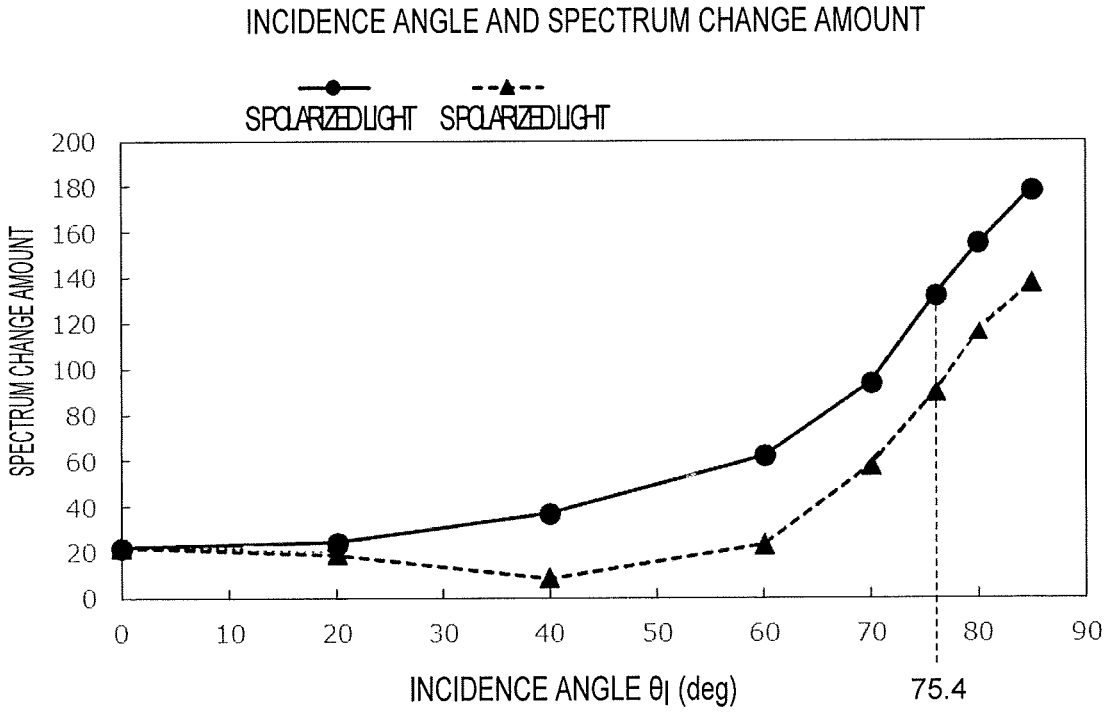
FIG. 10 is a graph illustrating relations between the change amount of the reflection spectrum and the incidence angle.

FIG. 10 is a graph illustrating relations between the change amount of the reflection spectrum and the incidence angle. The horizontal axis represents the incidence angle $\theta_I$ of the irradiation light $L_I$. The vertical axis represents the change amount of the reflection spectrum caused by changes in the film thickness of the silicon dioxide film 23. For example, the change amount of the reflection spectrum is a value obtained by integrating the absolute value of a difference in the spectrum between a case where the film thickness of the silicon dioxide film 23 is 500 nanometers and a case where the film thickness thereof is 400 nanometers with respect to the wavelength of the irradiation light $L_I$. The change amount of the reflection spectrum is larger in the S polarized light than in the P polarized light. As the incidence angle $\theta_I$ of the irradiation light $L_I$ is larger, the change amounts in the reflection spectra of the S polarized light and the P polarized light increase. Particularly at incidence angles (equal to and larger than 75.4 degrees) where the light quantity of the first reflection light LrS1 is above the light quantity of the third reflection light LrS3, the change amounts of the reflection spectra significantly increase.

As described above, according to the present embodiment, the incidence angle $\theta_I$ of the irradiation light $L_I$ is set to enable the light quantity of the S polarized light of the first reflection light from the front surface of the silicon dioxide film 23 and the light quantity of the S polarized light of the second reflection light from the back surface of the silicon dioxide film 23 to exceed the light quantity of the S polarized lights of the reflection lights from layers lower than the silicon dioxide film 23. For example, the incidence angle $\theta_I$ is set to be equal to or larger than about 75.4 degrees. This can increase the change amount of the reflection spectrum caused by the film thickness change in the silicon dioxide film 23 (the difference between the reflectance of the first reflection light LrS1 and the reflectance of the second reflection light LrS2) and can improve the accuracy in the detection of the end point of the polishing processing.

Second Embodiment

Figure 11:
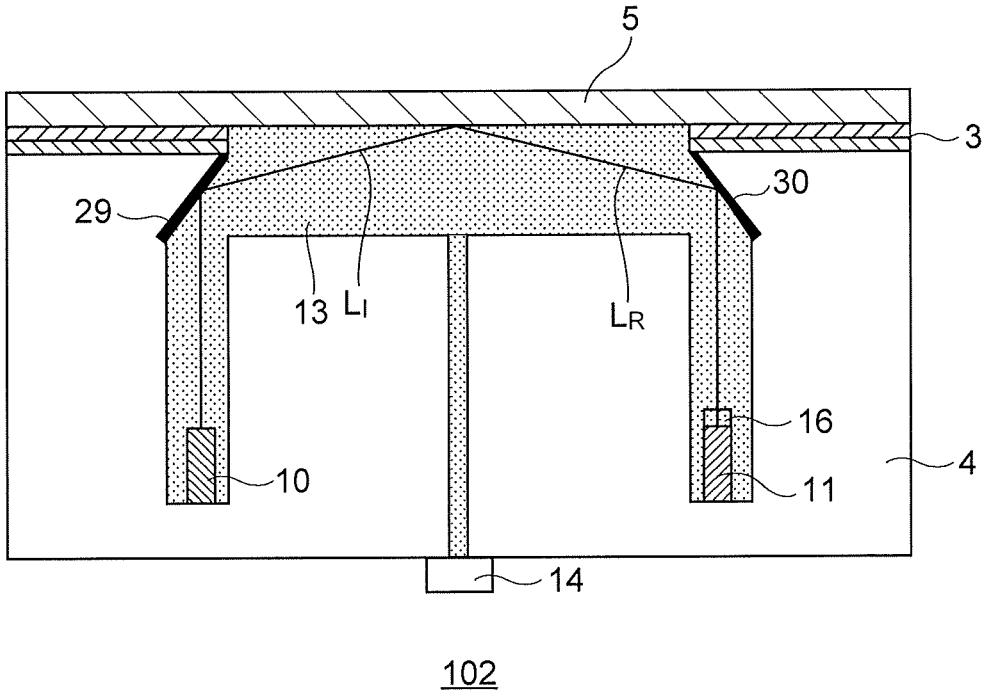
FIG. 11 is a schematic sectional view illustrating a configuration example of a polishing apparatus according to a second embodiment.

FIG. 11 is a schematic sectional view illustrating a configuration example of a polishing apparatus according to a second embodiment. FIG. 11 illustrates a configuration of the opening 12 and a peripheral part thereof. A polishing apparatus 102 according to the second embodiment further includes a first mirror 29 and a second mirror 30. In the second embodiment, the irradiator 10 and the photoreceiver 11 are placed in such a manner that the emitting surface and the photoreceptive surface face substantially vertically upward from below the polishing pad 3, respectively. The first mirror 29 serving as a first reflector bends the irradiation light $L_I$ from the irradiator 10 in a direction tilted to the silicon dioxide film 23. The second mirror 30 serving as a second reflector bends the reflection light $L_R$ from the silicon dioxide film 23 to the photoreceiver 11. The first mirror 29 is provided on an upper inner wall of the optical path region 13 filled with pure water and is placed in the vertical direction of the irradiator 10. The first mirror 29 can change the direction of the irradiation light $L_I$ from the irradiator 10 to change the incidence angle $\theta_I$ to a desired angle. The second mirror 30 is also provided on an upper inner wall of the optical path region 13 filled with pure water and is placed in the vertical direction of the photoreceiver 11. The second mirror 30 changes the direction of the reflection light $L_R$ from the silicon dioxide film 23 to enable the reflection light $L_R$ to reach the photoreceiver 11.

Due to this placement of the first and second mirrors 29 and 30, the irradiator 10 and the photoreceiver 11 do not need to be obliquely placed on an extension of the optical path and can be placed at a freely-selected position on the polishing table 4. Because the irradiator 10 and the photoreceiver 11 are relatively large members, longitudinally placing the irradiator 10 and the photoreceiver 11 vertically below the first and second mirrors 29 and 30, respectively, as illustrated in FIG. 11 can suppress increase in the size of the polishing table 4. Suppression of increase in the size of the polishing table 4 can suppress the arrangement area of the polishing apparatus.

Other configurations and operations of the second embodiment are identical to the corresponding configurations and operations of the first embodiment. Therefore, the second embodiment can also achieve the effects of the first embodiment.

Third Embodiment

FIG. 12 is a schematic sectional view illustrating a configuration example of a polishing apparatus according to a third embodiment. A polishing apparatus 103 according to the third embodiment further includes an optical fiber cable 31, an optical rotary joint 32, a light source 33, and a detector 34. The light source 33 and the detector 34 are arranged outside the polishing table 4 and are fixedly placed without rotating with the polishing table 4. The light source 33 and the detector 34 are optically connected to the optical rotary joint 32 with the optical fiber cable 31 and are further optically connected to the irradiator 10 and the photoreceiver 11, respectively, with the optical fiber cable 31 from the optical rotary joint 32. The light source 33 transmits the irradiation light $L_I$ to the irradiator 10 via the optical fiber cable 31 and the optical rotary joint 32. The detector 34 performs photoelectric conversion of the reflection light $L_R$ from the photoreceiver 11 via the optical fiber cable 31 and the optical rotary joint 32 to detect an electrical signal thereof.

With this installation of the light source 33 and the detector 34 outside the polishing table 4, the mechanism of the rotating polishing table 4 can be downscaled or reduced in the weight. Other configurations and operations of the third embodiment are identical to the corresponding configurations and operations of the first embodiment. Therefore, the third embodiment can also achieve the effects of the first embodiment. The third embodiment may be also combined with the second embodiment. While the pure water supplier 14 may be provided in FIG. 11, illustrations thereof are omitted. Illustrations of the optical fiber cable 31, the optical rotary joint 32, the light source 33, and the detector 34 are also omitted in the first and second embodiments.

Fourth Embodiment

FIGS. 13A and 13B are schematic sectional views illustrating a configuration example of a polishing apparatus according to a fourth embodiment. FIGS. 13A and 13B illustrate a configuration of the opening 12 and a peripheral part thereof. According to the fourth embodiment, the irradiator 10 irradiates the silicon dioxide film 23 with the irradiation light $L_I$ in such a manner that the irradiation light $L_I$ has an elongated shape on the silicon dioxide film 23. For example, an emission part of the irradiator 10 is formed in an elongated slit shape and forms the irradiation light $L_I$ in an elongated slit shape having a longitudinal direction in a tilt direction of the incidence angle $\theta_I$. With the irradiation light $L_I$ in the slit shape, the reflection light $L_R$ also has an elongated slit shape. The photoreceiver 11 is placed in the longitudinal direction of the irradiation light $L_I$ and receives a portion of the reflection light $L_R$ in the slit shape. An irradiation area 36 on the semiconductor substrate 5 irradiated with the irradiation light $L_I$ also has an elongated slit shape in the incident direction of the incidence angle $\theta_I$ similarly to the irradiation light $L_I$.

When the polishing pad 3 is worn, is compressed by a pressing force during polishing, or is replaced with a polishing pad having another structure, the thickness of the polishing pad 3 may change. If the thickness of the polishing pad 3 changes, the vertical distances between the irradiator 10 and the semiconductor substrate 5 and between the photoreceiver 11 and the semiconductor substrate 5 change correspondingly. Therefore, when the irradiation light $L_I$ is incident obliquely, the irradiation position on the silicon dioxide film 23 changes in a horizontal direction if the thickness of the polishing pad 3 changes. For example, when the polishing pad 3 has a relatively-thick stack structure (a stack structure including the polishing layer 1 and the cushion layer 2, for example), the irradiation position of the irradiation light $L_I$ on the semiconductor substrate 5 is provided on the right side of the opening 12 as illustrated in FIG. 13A. On the other hand, when the polishing pad 3 has a thin single-layer structure (a single-layer structure including the polishing layer 1, for example), the irradiation position of the irradiation light $L_I$ on the semiconductor substrate 5 is displaced to the left side of the opening 12 as illustrated in FIG. 13B. This displacement of the irradiation position of the irradiation light $L_I$ due to a change in the thickness of the polishing pad 3 is larger as the incidence angle $\theta_I$ of the irradiation light $L_I$ is larger.

If the irradiation light $L_I$ has a short shape, it may be difficult for the photoreceiver 11 to receive the reflection light $L_R$ because the irradiation position of the irradiation light $L_I$ is displaced when the thickness of the polishing pad 3 changes.

In contrast thereto, according to the fourth embodiment, even when the thickness of the polishing pad 3 changes and the irradiation area 36 on the semiconductor substrate 5 (the silicon dioxide film 23) changes, the photoreceiver 11 can receive at least a portion of the reflection light $L_R$ because the irradiation light $L_I$ and the reflection light $L_R$ have an elongated slit shape in the irradiation direction. Accordingly, even when the thickness of the polishing pad 3 changes, the polishing apparatus 104 can reliably measure the film thickness of the silicon dioxide film 23.

In the present embodiment, the opening 12 is formed by removing the polishing pad 3 on the optical path. Therefore, in order to fill the optical path region 13 with pure water, it is preferable that the volume or area of the opening 12 be small. Accordingly, it is preferable that the opening 12 have an elongated slit shape as well as the irradiation light $L_I$.

According to the fourth embodiment, the incidence angle $\theta_I$ can be small. However, as the incidence angle $\theta_I$ is larger, the effect is larger. For example, a length $L_{rad}$ of the irradiation area 36 in the longitudinal direction can be represented by expression 1 assuming that the maximum displacement amount of the semiconductor substrate 5 in the vertical direction (that is, the change amount of the thickness of the polishing pad 3) is $d_{Vmax}$.

$$L_{rad} \geq 2d_{Vmax} \tan \theta_I \quad \text{(expression 1)}$$

When $d_{Vmax}$ is 1.5 millimeters and the incidence angle is 45 degrees, it is preferable that the length $L_{rad}$ of the irradiation area 36 in the longitudinal direction be equal to or larger than 3.0 millimeters. When $d_{Vmax}$ is 1.5 millimeters and the incidence angle is 75.4 degrees, it is preferable that the length $L_{rad}$ is equal to or larger than 11.5 millimeters. This enables the photoreceiver 11 to reliably receive the reflection light $L_R$ even when the thickness of the polishing pad 3 changes.

Other configurations and operations of the fourth embodiment are identical to the corresponding configurations and operations of the first embodiment. Therefore, the fourth embodiment can also achieve the effects of the first embodiment. While the pure water supplier 14 may be provided in FIG. 13, illustrations thereof are omitted.

Fifth Embodiment

FIG. 14 is a schematic sectional view illustrating a configuration example of a polishing apparatus according to a fifth embodiment. A polishing apparatus 105 according to the fifth embodiment further includes a movement mechanism 80, a polishing-pad-thickness measuring part 81, the computing part 85, and a storage part 86.

The movement mechanism 80 moves the irradiator 10 or the photoreceiver 11 in a substantially vertical direction D1 or a substantially horizontal direction D2. The movement mechanism 80 is, for example, an actuator such as a motor or a power cylinder. A movement method of the irradiator 10 and the photoreceiver 11 will be explained later with reference to FIGS. 15A to 15C.

A location sensor 87 is provided on the dresser mechanism 9 and the location sensor 87 detects a height location of the dresser mechanism 9. This enables the film thickness of the polishing pad 3 to be measured. The polishing-pad-thickness measuring part 81 is connected to the location sensor 87 and measures the change amount of the film thickness of the polishing pad 3 on the basis of the height location of the dresser mechanism 9. The computing part 85 includes a distance estimator and a movement amount calculator. The distance estimator estimates a change amount of a distance in the direction D1 between the semiconductor substrate 5 and the irradiator 10 or a distance in the direction D1 between the semiconductor substrate 5 and the photoreceiver 11 on the basis of the change amount of the film thickness of the polishing pad 3. The movement amount calculator calculates a movement amount of the irradiator 10 and/or the photoreceiver 11 on the basis of the change amount of the distance between the semiconductor substrate 5 and the irradiator 10 or the photoreceiver 11 and the incidence angle $\theta_I$. The movement mechanism 80 moves the irradiator 10 and/or the photoreceiver 11 according to the movement amount obtained from the movement amount calculator.

FIGS. 15A to 15C are schematic sectional views illustrating a movement method of the irradiator 10 and the photoreceiver 11 according to the fifth embodiment. In FIG. 15A, the polishing pad 3 has a relatively-thick stack structure (a stack structure including the polishing layer 1 and the cushion layer 2, for example). In FIGS. 15B and 15C, the polishing pad 3 has a relatively-thin single-layer structure (a single-layer structure including the polishing layer 1, for example).

In the fifth embodiment, when the thickness of the polishing pad 3 changes, the movement mechanism 80 moves the irradiator 10 and the photoreceiver 11 in a substantially horizontal direction or a substantially vertical direction to enable the photoreceiver 11 to receive the reflection light $L_R$ and to maintain an irradiation position 37 of the irradiation light $L_I$ on the semiconductor substrate 5 at a substantially same position. For example, when the polishing pad 3 is relatively thick, the irradiator 10 and the photoreceiver 11 are placed at positions illustrated in FIG. 15A. When the polishing pad 3 is thinned, the movement mechanism 80 can move the irradiator 10 and the photoreceiver 11 in a substantially horizontal direction as illustrated in FIGS. 15A and 15B. Alternatively, the movement mechanism 80 may move the irradiator 10 and the photoreceiver 11 in a substantially vertical direction as illustrated in FIGS. 15A and 15C when the polishing pad 3 is thinned. Furthermore, the movement mechanism 80 can combine substantially horizontal movement and substantially vertical movement of the irradiator 10 and the photoreceiver 11.

When the irradiator 10 and the photoreceiver 11 are moved in a substantially horizontal direction as illustrated in FIG. 15B, respective movement amounts $m_H$ of the irradiator 10 and the photoreceiver 11 can be represented by expression 2 assuming the distance between the irradiator 10 or the photoreceiver 11 and the semiconductor substrate 5, or the change amount of the distance as $d_V$.

$$m_H = d_V \tan \theta_I \quad \text{(expression 2)}$$

When the irradiator 10 and the photoreceiver 11 are moved in a substantially vertical direction as illustrated in FIG. 15C, respective movement amounts $m_H$ of the irradiator 10 and the photoreceiver 11 are substantially equal to the change amount (movement distance) $d_V$ in the vertical direction of the semiconductor substrate 5.

As described above, according to the fifth embodiment, the polishing-pad-thickness measuring part 81 measures the thickness of the polishing pad 3 or the change amount of the thickness, and the computing part 85 estimates the change amount $d_V$ of the distance between the irradiator 10 or the photoreceiver 11 and the semiconductor substrate 5 on the basis of the thickness of the polishing pad 3 or the change amount of the thickness, measured by the polishing-pad-thickness measuring part 81. The change amount $d_V$ is sometimes equal to the change amount of the thickness of the polishing pad 3. The computing part 85 further determines the movement amounts (movement distances) $m_H$ of the irradiator 10 and the photoreceiver 11 on the basis of the change amount $d_V$. The movement mechanism 80 receives the movement amounts $m_H$ from the computing part 85 and moves the irradiator 10 and the photoreceiver 11 in a substantially horizontal direction or a substantially vertical direction according to the movement amounts $m_H$.

Accordingly, even when the thickness of the polishing pad 3 changes and the location of the semiconductor substrate 5 displaces in the vertical direction, the optical path can be controlled to enable the photoreceiver 11 to reliably receive the reflection light $L_R$. Furthermore, the irradiation position 37 of the irradiation light $L_I$ on the semiconductor substrate 5 can be maintained at a substantially same position even when the thickness of the polishing pad 3 changes and the location of the semiconductor substrate 5 displaces in the vertical direction. As a result, the polishing apparatus 105 can further improve the accuracy in the detection of the end point.

According to the fifth embodiment, the incidence angle $\theta_I$ can be small. However, the effect is larger as the incidence angle $\theta_I$ is larger. The movement mechanism 80 can move both the irradiator 10 and the photoreceiver 11 or may move only either the irradiator 10 or the photoreceiver 11. When only either the irradiator 10 or the photoreceiver 11 is moved, the irradiation position 37 of the irradiation light $L_I$ on the semiconductor substrate 5 displaces while the photoreceiver 11 can receive the reflection light $L_R$. Therefore, the configuration of the movement mechanism 80 can be downscaled and simplified while the accuracy in the detection of the end point is degraded to some extent.

In the above example, the thickness of the polishing pad 3 is measured by the location sensor 87 placed on the dresser mechanism 9. However, the location sensor 87 may be placed on the polishing head 6 or may be installed on the polishing pad 3 as an independent mechanism. Alternatively, the thickness of the polishing pad 3 may be measured using a sensor such as an optical sensor, instead of the location sensor 87. The thickness of the polishing pad 3 may be estimated on the basis of a correlation between the number of polished semiconductor substrates 5, the use time of the polishing pad 3, or the dressing time of the polishing pad 3 and the thickness of the polishing pad 3. The number of polished semiconductor substrates 5, the use time of the polishing pad 3, or the dressing time of the polishing pad 3 can be obtained from history information of past processing. The correlation between the number of polished semiconductor substrates 5 or the like and the thickness of the polishing pad 3 is also calculated on the basis of past polishing records. The history information, the correlation, and the like are stored in the storage part 86 in advance and are used by the computing part 85 to calculate the thickness of the polishing pad 3 in the subsequent polishing processing.

The change amount of the distance between the semiconductor substrate 5 and the irradiator 10 or the photoreceiver 11 may be measured or estimated on the basis of the distance between the polishing head 6 and the polishing table 4 regardless of the thickness of the polishing pad 3. In this case, it suffices to place proximity sensors or the like on the polishing head 6 and the polishing table 4 to measure the distance between the polishing head 6 and the polishing table 4.

The fifth embodiment may be applied to any of the first to fourth embodiments. When the fifth embodiment is applied to the second embodiment, it suffices that the movement mechanism 80 moves the location of the first mirror 29 and/or the second mirror 30 instead of the location of the irradiator 10 and/or the photoreceiver 11.

In the fifth embodiment, an opening is provided on the polishing pad 3. A transmissive window (46 or 62) according to eighth to tenth embodiments may be provided on the opening of the polishing pad 3.

Sixth Embodiment

The semiconductor substrate 5 illustrated in FIG. 4 has the silicon nitride film 22 under the silicon dioxide film 23 being the polishing target. However, in a case where there is a silicon carbide film under the silicon dioxide film 23 being the polishing target, the incidence angle $\theta_I$ that enables the light quantities of the S polarized lights of the first and second reflection lights to exceed the light quantity of the S polarized light of the third reflection light is equal to or larger than about 78.6 degrees. In this manner, when a different material is included in the stack structure provided in the semiconductor substrate 5, an appropriate incidence angle $\theta_I$ also changes.

Figure 16:
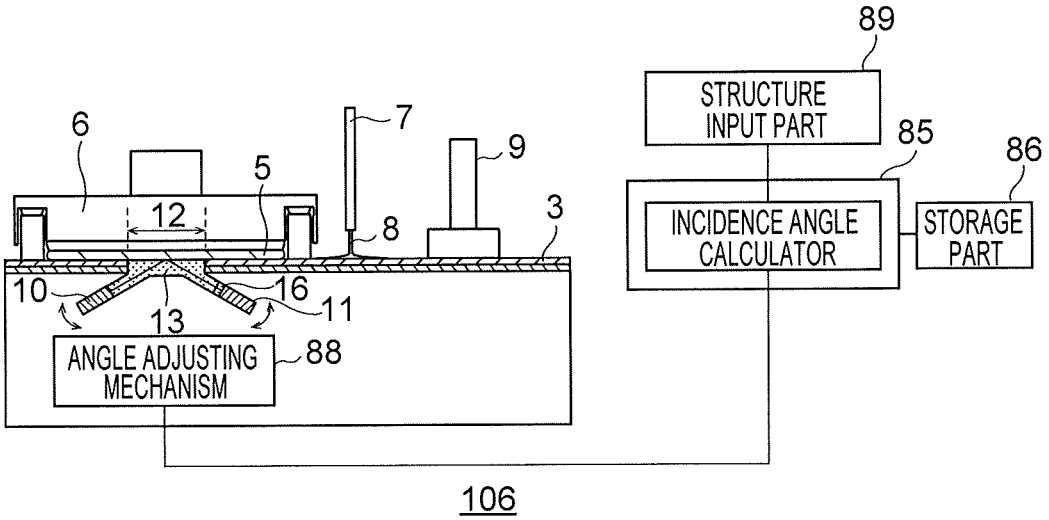
FIG. 16 is a sectional view illustrating a configuration example of the polishing apparatus according to the sixth embodiment.

Accordingly, a polishing apparatus 106 according to a sixth embodiment includes an angle adjusting mechanism 88 and a structure input part 89. FIG. 16 is a sectional view illustrating a configuration example of the polishing apparatus according to the sixth embodiment. The angle adjusting mechanism 88 being a driver changes tilts of the irradiator 10 and the photoreceiver 11 to enable the light quantities of the S polarized lights of the first and second reflection lights to exceed the light quantity of the S polarized light of the third reflection light on the basis of the structure of the semiconductor substrate 5 input to the structure input part 89.

A user inputs information such as materials of the stack structure of the semiconductor substrate 5 being a polishing target to the structure input part 89. The information of the stack structure is stored in the storage part 86. An incidence angle calculator in the computing part 85 calculates the incidence angle $\theta_I$ to enable the light quantities of the S polarized lights of the first and second reflection lights to exceed the light quantity of the S polarized light of the third reflection light using respective refractive indices or the like of the materials of the stack structure. The angle adjusting mechanism 88 adjusts the tilts of the irradiator 10 and the photoreceiver 11 according to the incidence angle $\theta_I$ calculated by the incidence angle calculator.

Accordingly, even when different materials are included in the stack structure provided in the semiconductor substrate 5, the incidence angle $\theta_I$ can be set to enable the light quantities of the S polarized lights of the first and second reflection lights to exceed the light quantity of the S polarized light of the third reflection light. As a result, the polishing apparatus 106 can improve the accuracy in detection of the end point.

The sixth embodiment may be applied to any of the first to fourth embodiments. When the sixth embodiment is applied to the second embodiment, it suffices that the angle adjusting mechanism 88 changes the angle(s) of the first mirror 29 and/or the second mirror 30 instead of the angle(s) of the photoreceiver 10 and/or the photoreceiver 11.

Seventh Embodiment

Figure 17:
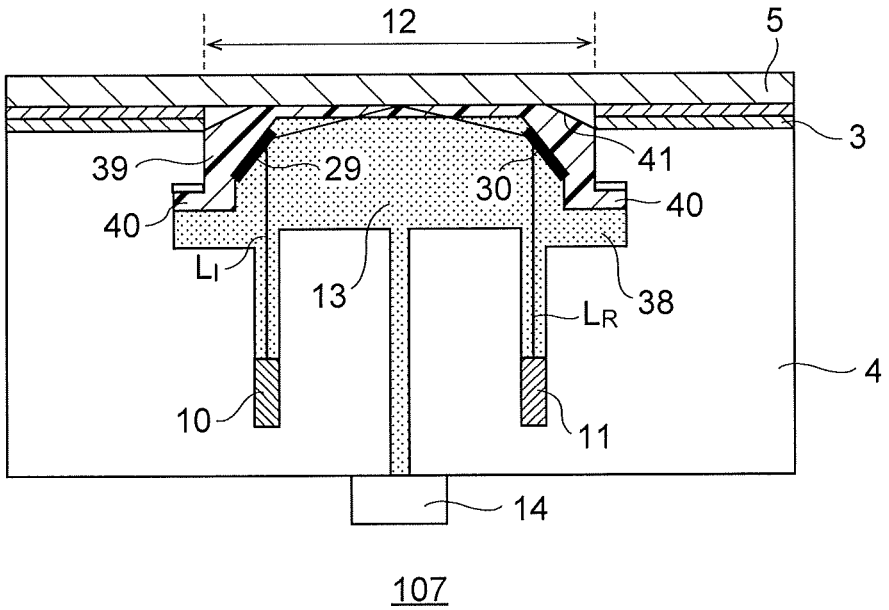
FIG. 17 is a schematic sectional view illustrating a configuration example of a polishing apparatus according to a seventh embodiment.

FIG. 17 is a schematic sectional view illustrating a configuration example of a polishing apparatus according to a seventh embodiment. FIG. 17 illustrates a configuration of the opening 12 and a peripheral part thereof. A polishing apparatus 107 according to the seventh embodiment is same as that according to the second embodiment in a feature of including the first mirror 29 and the second mirror 30. The polishing apparatus 107 is also same as that according to the second embodiment in that the irradiator 10 and the photoreceiver 11 are placed vertically below the first and second mirrors 29 and 30, respectively.

However, in the seventh embodiment, an optical-path change mechanism 39 is provided in the optical path region 13. The optical-path change mechanism 39 is movable in a substantially perpendicular direction to the polishing face of the semiconductor substrate 5 in the optical path region 13. The first and second mirrors 29 and 30 are placed on the optical-path change mechanism 39. Therefore, the first and second mirrors 29 and 30 are movable in the substantially perpendicular direction to the polishing face of the semiconductor substrate 5 along with the optical-path change mechanism 39. The first mirror 29 bends the irradiation light $L_I$ applied substantially vertically upward from the irradiator 10 in a direction tilted to the semiconductor substrate 5. The second mirror 30 bends the reflection light $L_R$ from the semiconductor substrate 5 to the photoreceiver 11. A material (quartz glass, for example) that transmits a light from the irradiator 10 and a light to the photoreceiver 11 is used as the optical-path change mechanism 39.

The opening 12 is provided on the polishing pad 3 and the top surface of the optical-path change mechanism 39 is in contact with the polishing face of the semiconductor substrate 5 along with the polishing pad 3. The pure water supplier 14 that supplies pure water to the optical path region 13 is provided below the optical-path change mechanism 39. At the time of polishing processing, the pure water supplier 14 supplies pure water to the optical path region 13 to push up the optical-path change mechanism 39 with the pressure of the pure water. This causes the optical-path change mechanism 39 to be pressed against the polishing face of the semiconductor substrate 5. At this time, it is preferable that the pressure of pushing up the optical-path change mechanism 39 be lower than a polishing pressure of pressing the semiconductor substrate 5 against the polishing pad 3 to prevent the semiconductor substrate 5 from floating up from the polishing pad 3 and not to interfere the polishing processing of the semiconductor substrate 5.

Accordingly, when the thickness of the polishing pad 3 changes, the optical-path change mechanism 39 is pushed by the semiconductor substrate 5 to move in a substantially vertical direction according to movement of the semiconductor substrate 5 in a substantially vertical direction. Therefore, even when the thickness of the polishing pad 3 changes, the optical-path change mechanism 39 can maintain the distance between the polishing face of the semiconductor substrate 5 and the first and second mirrors 29 and 30.

In the seventh embodiment, the distance between the polishing face of the semiconductor substrate 5 and the first and second mirrors 29 and 30 is maintained by pressing the optical-path change mechanism 39 against the semiconductor substrate 5. However, the distance between the polishing face and the mirrors 29 and 30 may be maintained by other methods. For example, the location of the optical-path change mechanism 39 can be adjusted based on the distance between the polishing face and the mirrors 29 and 39. The distance between the polishing face and the mirrors 29 and 30 can be measured by a sensor or be estimated from a measurement result of the thickness of the polishing pad 3. The optical-path change mechanism 39 does not always need to be in contact with the semiconductor substrate 5.

While the optical-path change mechanism 39 is pressed against the semiconductor substrate 5 with the pressure of pure water in the seventh embodiment, other transparent liquids (fluids) may be used instead of pure water. Although not illustrated in the drawings, the optical-path change mechanism 39 may be pressed against the semiconductor substrate 5 using other drive mechanisms such as a power cylinder.

At least a part of the outer edge portion of the top surface of the optical-path change mechanism 39 has a tilted portion 41 and is chamfered. The tilted portion 41 may be a round part having a certain curvature. When the semiconductor substrate 5 moves away from the optical-path change mechanism 39 with rotation of the polishing table 4, the center portion of the optical-path change mechanism 39 may be raised to a position higher than the surface of the polishing pad 3 due to the pressure of pure water in the optical path region 13. However, with the outer edge portion of the optical-path change mechanism 39 placed at a position lower than the surface of the polishing pad 3 due to the tilted portion 41, the semiconductor substrate 5 can run on the optical-path change mechanism 39 from the tilted portion 41 and push down the top surface of the optical-path change mechanism 39 to the height of the surface of the polishing pad 3 with the pressure of the polishing head 6 when the semiconductor substrate 5 returns. Accordingly, the state illustrated in FIG. 17 is realized again. Therefore, the distance between the polishing face of the semiconductor substrate 5 and the first and second mirrors 29 and 30 can be maintained to be substantially constant each time the semiconductor substrate 5 arrives on the optical-path change mechanism 39.

The optical-path change mechanism 39 has a stopper 40 to maintain the outer edge portion of the optical-path change mechanism 39 to be lower than the surface of the polishing pad 3 even when the semiconductor substrate 5 is not provided on the optical-path change mechanism 39. The stopper 40 protrudes in a substantially horizontal direction and is received in a concave portion provided in a substantially horizontal direction of the optical path region 13. When the optical-path change mechanism 39 moves substantially vertically upward, the stopper 40 abuts on the top surface of the concave portion of the optical path region 13, so that the optical-path change mechanism 39 stops and cannot move upward any more. This enables the outer edge of the optical-path change mechanism 39 to be maintained at a position lower than the surface of the polishing pad 3.

The pressure of the pure water in the optical path region 13 can be controlled synchronously with rotation of the polishing table 4 to prevent the top surface of the optical-path change mechanism 39 from protruding from the surface of the polishing pad 3 when the semiconductor substrate 5 is not provided on the optical-path change mechanism 39. In this case, there is no need to provide the tilted portion 41 at the outer edge portion of the optical-path change mechanism 39.

According to the seventh embodiment, the optical-path change mechanism 39 is pressed against the polishing face of the semiconductor substrate 5 and therefore the distance between the first and second mirrors 29 and 30 being bend points of the irradiation light $L_I$ and the reflection light $L_R$ and the polishing face of the semiconductor substrate 5 can be set to be substantially constant regardless of the thickness of the polishing pad 3. Therefore, the polishing apparatus 107 can irradiate a same region on the polishing face of the semiconductor substrate 5 with the irradiation light $L_I$ and enables the reflection light $L_R$ to reliably reach the photoreceiver 11 without moving the irradiator 10 and the photoreceiver 11.

When the surface of the polishing pad 3 is to be dressed after polishing ends, the optical-path change mechanism 39 is moved downward to lower the top surface of the optical-path change mechanism 39 to be lower than the surface of the polishing pad 3. Therefore, damages on the optical-path change mechanism 39 due to the dresser mechanism 9 can be suppressed.

Because being independent of the polishing table 4, the optical-path change mechanism 39 can be detached from the polishing table 4 and be replaced. In this case, the optical-path change mechanism 39 may be replaced with an optical-path change mechanism having another configuration in order to enable the incidence angle $\theta_I$ to be changed according to the stack structure included in the semiconductor substrate 5.

Figure 18:
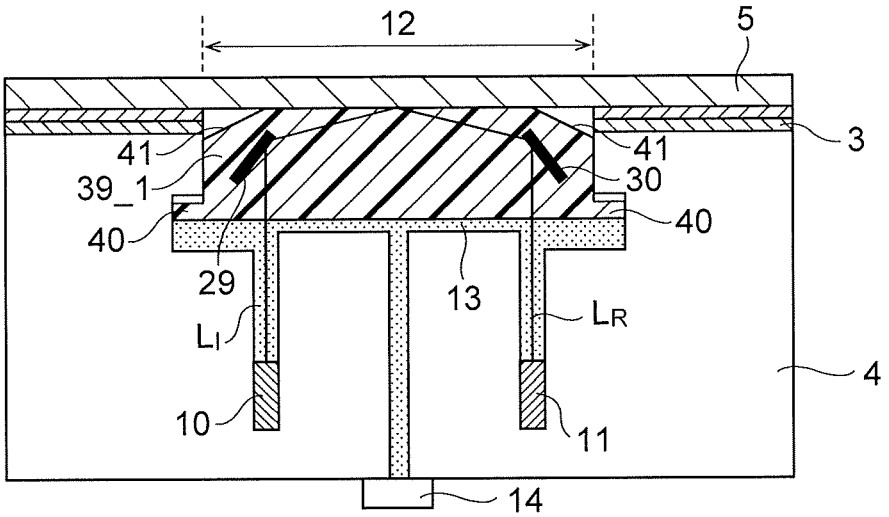
FIGS. 18 to 20 are sectional views illustrating modifications of the polishing apparatus according to the seventh embodiment.
Figure 19:
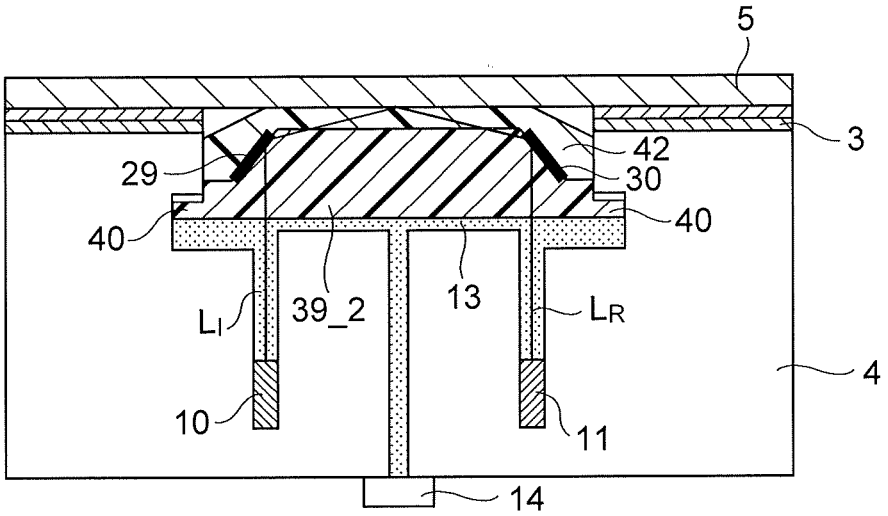
Figure 20:
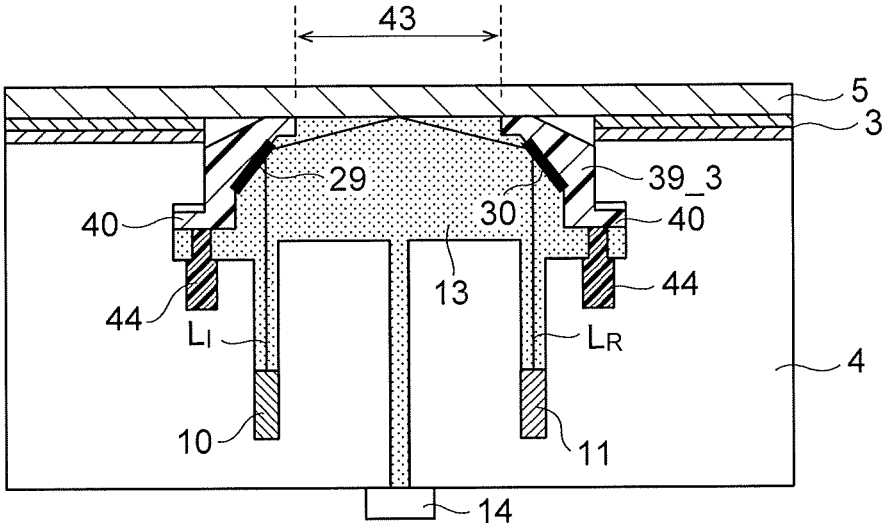

FIGS. 18 to 20 are sectional views illustrating modifications of the polishing apparatus according to the seventh embodiment. An optical-path change mechanism 39_1 illustrated in FIG. 18 has the first and second mirrors 29 and 30 embedded in quartz glass. The optical-path change mechanism 39_1 has fewer refracting surfaces in the middle of the optical paths between the mirrors 29 and 30 and the semiconductor substrate 5 than in the optical-path change mechanism 39 illustrated in FIG. 17. The irradiation light $L_I$ from the irradiator 10 is incident on the interface between pure water and the optical-path change mechanism 39_1 in a substantially perpendicular direction thereto. The reflection light $L_R$ from the second mirror 30 is outgoing from the interface between the pure water and the optical-path change mechanism 39_1 in a substantially perpendicular direction thereto. Therefore, there are fewer refracting surfaces on the optical paths of the irradiation light $L_I$ and the reflection light $L_R$ and the optical-path change mechanism 39_1 can be designed more easily.

An optical-path change mechanism 39_2 illustrated in FIG. 19 has a transmissive resin 42 on a contact face with the semiconductor substrate 5. When quartz glass is brought into contact with the polishing face of the semiconductor substrate 5, scratches may be produced on the polishing face. The optical-path change mechanism 39_2 according to the present modification has the transmissive resin 42 softer than the semiconductor substrate 5 on the top surface, so that scratches on the semiconductor substrate 5 can be suppressed.

An optical-path change mechanism 39_3 illustrated in FIG. 20 has an opening 43 on at least a part of a contact face with the semiconductor substrate 5. Accordingly, the entire optical paths of the irradiation light $L_I$ and the reflection light $L_R$ are in the pure water in the optical path region 13 and there is no refracting surface. The semiconductor substrate 5 is irradiated with the irradiation light $L_I$ from the first mirror 29 through the opening 43. The reflection light $L_R$ reaches the second mirror 30 through the opening 43.

When there is the opening 43 in the optical path region 13, the pure water in the optical path region 13 cannot push up the optical-path change mechanism 39_3 with the pressure. Therefore, the polishing table 4 according to the present modification has a power cylinder mechanism 44 placed immediately under the stopper 40. The power cylinder mechanism 44 pushes up the optical-path change mechanism 39_3 in a substantially vertical direction to press the top surface of the optical-path change mechanism 39_3 against the polishing face of the semiconductor substrate 5. It is preferable that pushing-up force of the power cylinder mechanism 44 be lower than the polishing pressure of pressing the semiconductor substrate 5 against the polishing pad 3 to prevent the semiconductor substrate 5 from floating up from the polishing pad 3. In order to prevent mixture of the slurry 8, the pure water supplier 14 supplies pure water in the optical path region 13 similarly to other embodiments and other modifications.

In this way, the optical-path change mechanism 39 according to the seventh embodiment may be replaced with any of the optical-path change mechanisms 39_1 to 39_3 illustrated in FIGS. 18 to 20 and other optical-path change mechanisms to change the incidence angle of the irradiation light $L_I$. The mirrors 29 and 30 are used in the embodiments and the modifications described above. However, prisms may be used instead of the mirrors 29 and 30 to change the optical paths of the irradiation light $L_I$ and the reflection light $L_R$. Furthermore, the optical paths of the irradiation light $L_I$ and the reflection light $L_R$ may be changed by a combination of a mirror and a prism.

Eighth Embodiment

In the first to seventh embodiments, the polishing pad 3 has the opening 12 or 43 provided on the optical paths of the irradiation light $L_I$ and the reflection light $L_R$.

In contrast thereto, according to the eighth embodiment, the polishing pad 3 has a transmissive window 46 on the optical paths of the irradiation light $L_I$ and the reflection light $L_R$. The window 46 can be, for example, quartz glass or transmissive urethane.

Figure 21B:
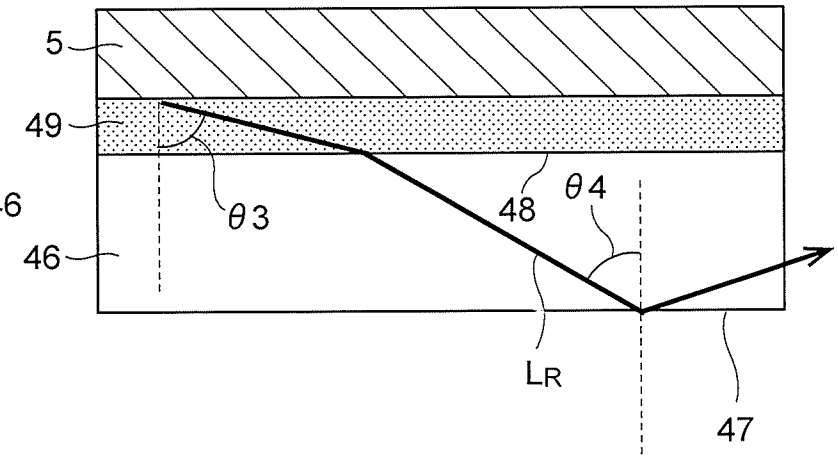
FIGS. 21A and 21B are sectional views illustrating a comparative example in which the bottom surface of the window is substantially parallel to the polishing face of the semiconductor substrate or the surface of the polishing pad.
Figure 21A:
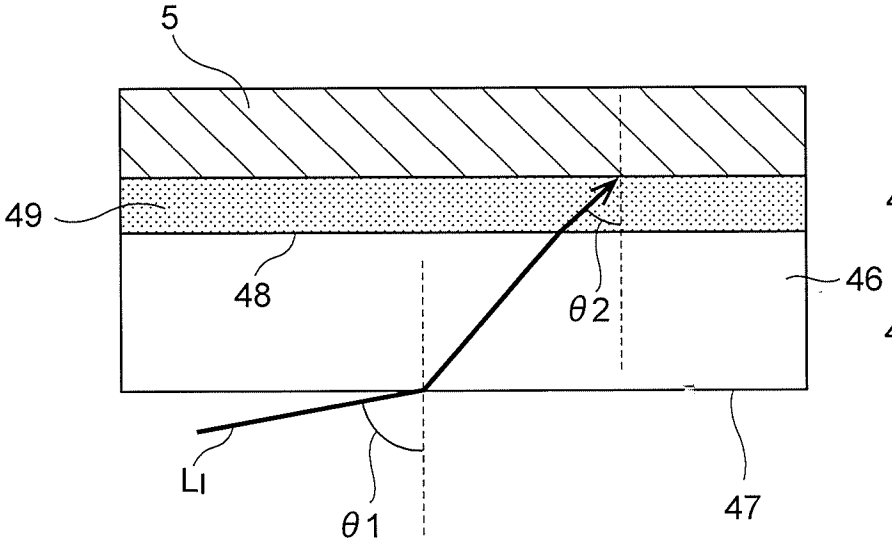

FIGS. 21A and 21B are sectional views illustrating a comparative example in which the bottom surface of the window 46 is substantially parallel to the polishing face of the semiconductor substrate 5 or the surface of the polishing pad 3. FIG. 21A illustrates the optical path of the irradiation light $L_I$ and FIG. 21B illustrates the optical path of the reflection light $L_R$.

As illustrated in FIG. 21A, the irradiation light $L_I$ from the irradiator 10 passes through air located under the window 46 and is refracted by a bottom surface 47 of the window 46. Further, the irradiation light $L_I$ reaches a top surface 48 of the window 46, is refracted again by water 49 located between the window 46 and the semiconductor substrate 5, and is applied to the polishing face of the semiconductor substrate 5. At this time, in order to increase an angle θ2 of incidence on the polishing face of the semiconductor substrate 5, an angle θ1 of incidence on the window bottom surface 47 needs to be larger than the angle θ2 of incidence considering refraction on the window bottom surface 47 and the window top surface 48. If the angle θ1 of incidence on the window bottom surface 47 is larger than a critical angle from air to the window, the light is entirely reflected from the window bottom surface 47 and the incident light cannot reach the semiconductor substrate 5. In order to solve this problem, the angle θ2 of incidence on the polishing face of the semiconductor substrate 5 has an upper limit. The upper limit of the incidence angle θ2 is a critical angle (48.6 degrees) from water to air regardless of the refractive index of the window 46. Therefore, the incidence angle θ2 cannot be increased to a value that can sufficiently intensify the interference between reflection lights from the top surface and the bottom surface of the polishing layer 1.

Meanwhile, the reflection light $L_R$ from the polishing face of the semiconductor substrate 5 is refracted by the top surface 48 of the window 46 through water and reaches the bottom surface 47 as illustrated in FIG. 21B. When an angle θ3 of reflection from the polishing face of the semiconductor substrate 5 exceeds the critical angle (48.6 degrees) from water to air, an angle θ4 of incidence of the reflection light $L_R$ on the bottom surface 47 exceeds the critical angle from the window 46 to air. Accordingly, the reflection light $L_R$ is entirely reflected from the bottom surface 47 of the window 46 without being outgoing into air and does not reach the photoreceiver 11.

In this case where the bottom surface 47 of the window 46 is designed to be substantially parallel to the polishing face of the semiconductor substrate 5, the incidence angle θ2 of the irradiation light $L_I$ cannot be set to be equal to or larger than the critical angle from water to air. Even if the incidence angle θ2 is set to be equal to or larger than the critical angle from water to air, the reflection angle θ3 of the reflection light $L_R$ exceeds the critical angle from water to air and accordingly the reflection light $L_R$ is entirely reflected from the bottom surface 47 of the window 46. Therefore, the photoreceiver 11 cannot detect the reflection light $L_R$.

Figure 22B:
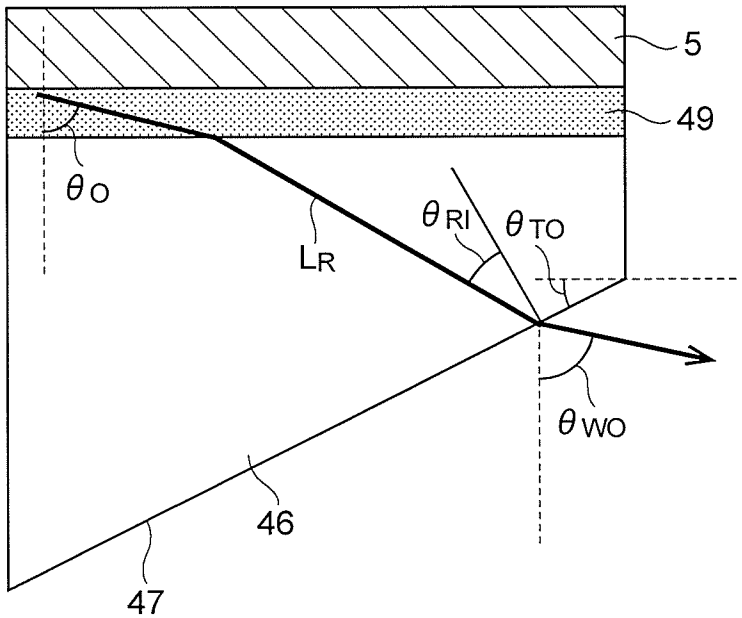
FIGS. 22A and 22B are sectional views illustrating a configuration example of the window according to the eighth embodiment.
Figure 22A:
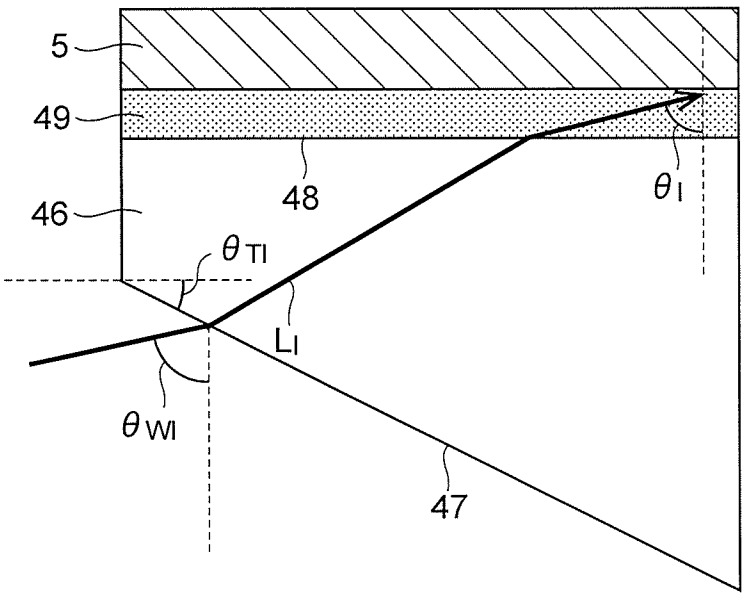

FIGS. 22A and 22B are sectional views illustrating a configuration example of the window 46 according to the eighth embodiment. As illustrated in FIG. 22A, the bottom surface 47 of the window 46 according to the eighth embodiment is tilted with respect to the polishing face of the semiconductor substrate 5 or the surface of the polishing pad 3 to enable an incidence angle $\theta_{WI}$ of the irradiation light $L_I$ to be increased. Assuming the tilt angle of the bottom surface 47 on the optical path of the irradiation light $L_I$ is $\theta_{TI}$, the incidence angle $\theta_{WI}$ of the irradiation light $L_I$ can be increased by the tilt angle $\theta_{TI}$ relative to the incidence angle θ1 in the comparative example. Accordingly, the angle of incidence of the irradiation light $L_I$ on the top surface 48 of the window 46 can be also increased and thus the angle θ1 of incidence of the irradiation light $L_I$ on the polishing face of the semiconductor substrate 5 can be set to an angle above the critical angle (48.6 degrees) from water to air. Therefore, the interference between the reflection lights from the top surface and the bottom surface of the polishing layer 1 can be sufficiently intensified.

As illustrated in FIG. 22B, the bottom surface 47 of the window 46 according to the eighth embodiment is tilted to the polishing face of the semiconductor substrate 5 or the surface of the polishing pad 3 to enable an outgoing angle $\theta_{WO}$ of the reflection light $L_R$ to be increased. The tilt direction of the bottom surface 47 on the optical path of the reflection light $L_R$ is opposite to that of the bottom surface 47 on the optical path of the irradiation light $L_I$. Assuming the tilt angle of the bottom surface 47 on the optical path of the reflection light $L_R$ is $\theta_{TO}$, an angle $\theta_{RI}$ of incidence of the reflection light $L_R$ on the bottom surface 47 can be decreased by the tilt angle $\theta_{TO}$ relative to that in the comparative example. Therefore, even if the reflection angle $\theta_O$ from the polishing face of the semiconductor substrate 5 is above the critical angle (48.6 degrees) from water to air, the incidence angle $\theta_{RI}$ can be set not to exceed the critical angle from the window 46 to air. This enables the reflection light $L_R$ to be emitted into air and the photoreceiver 11 can receive the reflection light $L_R$.

Ranges of the tilt angles $\theta_{TI}$ and $\theta_{TO}$ to obtain a desired incidence angle $\theta_I$ are represented by the following expressions 3 to 6. In these expressions, $n_{WATER}$ is the refractive index of water, $n_{WINDOW}$ is the refractive index of the window 46, and $n_{AIR}$ is the refractive index of air.

$$\theta_{TI} > \sin^{-1}\left(\frac{n_{WATER}}{n_{WINDOW}}\sin^{-1}\theta_I\right) - \sin^{-1}\left(\frac{n_{AIR}}{n_{WINDOW}}\right) \quad \text{(expression 3)}$$

-continued $$\theta_{TI} < \sin^{-1}\left(\frac{n_{WATER}}{n_{WINDOW}}\sin^{-1}\theta_I\right) + \sin^{-1}\left(\frac{n_{AIR}}{n_{WINDOW}}\right) \quad \text{(expression 4)}$$

$$\theta_{TO} > \sin^{-1}\left(\frac{n_{WATER}}{n_{WINDOW}}\sin^{-1}\theta_I\right) - \sin^{-1}\left(\frac{n_{AIR}}{n_{WINDOW}}\right) \quad \text{(expression 5)}$$

$$\theta_{TO} < \sin^{-1}\left(\frac{n_{WATER}}{n_{WINDOW}}\sin^{-1}\theta_I\right) + \sin^{-1}\left(\frac{n_{AIR}}{n_{WINDOW}}\right) \quad \text{(expression 6)}$$

Figure 23:
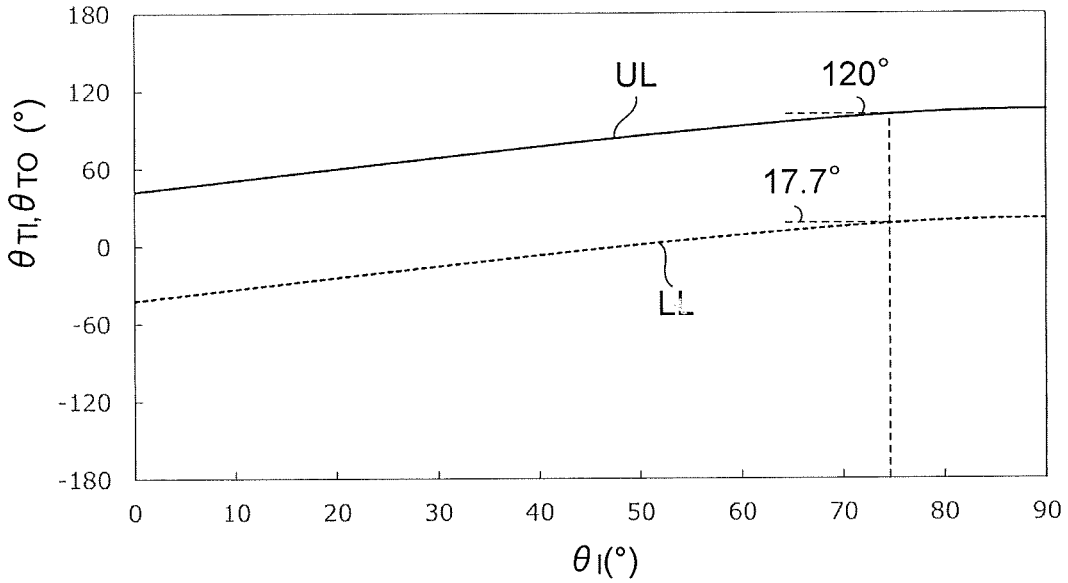
FIG. 23 is a graph illustrating relations between the incidence angle $\theta_I$ and the tilt angles $\theta_{TI}$ and $\theta_{TO}$.

FIG. 23 is a graph illustrating relations between the incidence angle $\theta_I$ and the tilt angles $\theta_{TI}$ and $\theta_{TO}$. The window 46 is assumed to be urethane (the refractive index is 1.490). An upper limit UL and a lower limit LL of the tilt angles $\theta_{TI}$ and $\theta_{TO}$ are obtained by expressions 3 to 6. The tilt angles $\theta_{TI}$ and $\theta_{TO}$ and the incidence angle $\theta_I$ can be set between the upper limit UL and the lower limit LL. For example, when the incidence angle $\theta_I$ is about 75.4 degrees, it is adequate to set the tilt angles $\theta_{TI}$ and $\theta_{TO}$ to values between about 17.7 degrees and about 120.0 degrees, respectively.

Furthermore, when the tilt angles $\theta_{TI}$ and $\theta_{TO}$ satisfy expressions 7 and 8 regardless of whether the incidence angle $\theta_I$ is above the critical angle from water to air, the incidence angle $\theta_{WI}$ and the outgoing angle $\theta_{WO}$ of the reflection light outgoing from the bottom surface 47 of the window 46 with respect to the vertical direction can be set to be smaller than the incidence angle $\theta_I$. This leads to downscaling of the irradiator 10 and the photoreceiver 11.

$$\sin^{-1}\left[\frac{n_{WINDOW}}{n_{AIR}}\left\{\sin^{-1}\left(\frac{n_{WATER}}{n_{WINDOW}}\sin\theta_I\right) - \theta_{TI}\right\}\right] + \theta_{TI} < \theta_I \quad \text{(expression 7)}$$

$$\sin^{-1}\left[\frac{n_{WINDOW}}{n_{AIR}}\left\{\sin^{-1}\left(\frac{n_{WATER}}{n_{WINDOW}}\sin\theta_I\right) - \theta_{TO}\right\}\right] + \theta_{TO} < \theta_I \quad \text{(expression 8)}$$

At this time, the incidence angle $\theta_{WI}$ and the outgoing angle $\theta_{WO}$ are represented by expressions 9 and 10, respectively.

$$\theta_{WI} = \theta_{TI} + \sin^{-1}\left[\frac{n_{WINDOW}}{n_{AIR}}\sin\left\{\sin^{-1}\left(\frac{n_{WATER}}{n_{WINDOW}}\sin\theta_I\right) - \theta_{TI}\right\}\right] \quad \text{(expression 9)}$$

$$\theta_{WO} = \theta_{TO} + \sin^{-1}\left[\frac{n_{WINDOW}}{n_{AIR}}\sin\left\{\sin^{-1}\left(\frac{n_{WATER}}{n_{WINDOW}}\sin\theta_I\right) - \theta_{TO}\right\}\right] \quad \text{(expression 10)}$$

Figure 24:
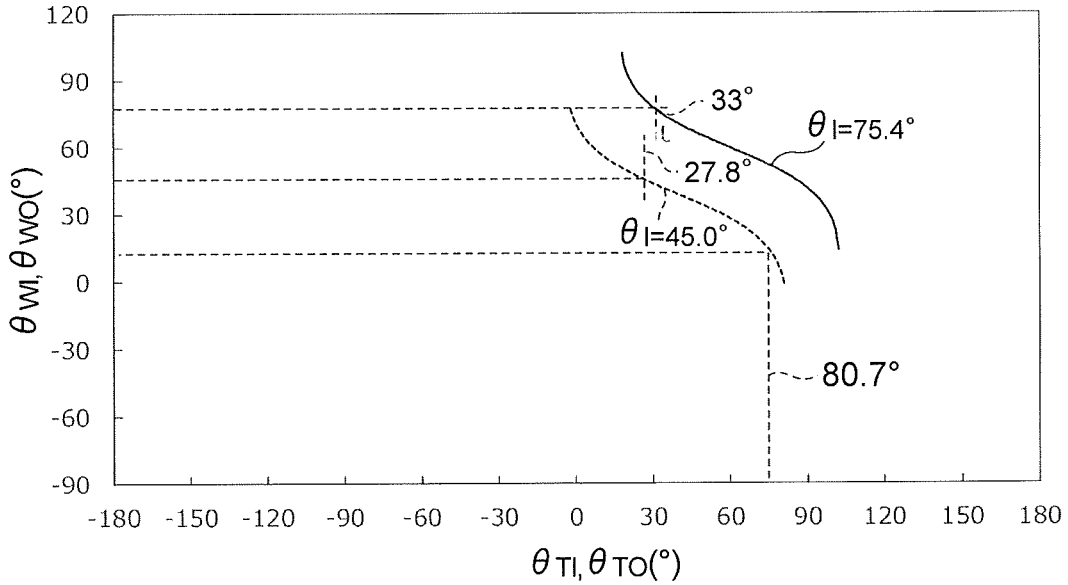
FIG. 24 is a graph illustrating relations between the tilt angles $\theta_{TI}$ and $\theta_{TO}$ and the incidence angle $\theta_{WI}$ and the outgoing angle $\theta_{WO}$.

FIG. 24 is a graph illustrating relations between the tilt angles $\theta_{TI}$ and $\theta_{TO}$ and the incidence angle $\theta_{WI}$ and the outgoing angle $\theta_{WO}$. The window 46 is assumed to be urethane (the refractive index is 1.490). When the incidence angle $\theta_I$ is 75.4 degrees, the tilt angles $\theta_{TI}$ and $\theta_{TO}$ need to be equal to or larger than about 33.0 degrees in order to set the incidence angle $\theta_{WI}$ and the outgoing angle $\theta_{WO}$ to be smaller than the incidence angle $\theta_I$. When the incidence angle $\theta_I$ is 45.0 degrees, the tilt angles $\theta_{TI}$ and $\theta_{TO}$ need to be equal to or larger than about 27.8 degrees in order to set the incidence angle $\theta_{WI}$ and the outgoing angle $\theta_{WO}$ to be smaller than the incidence angle $\theta_I$. Furthermore, when the incidence angle $\theta_I$ is 45.0 degrees, the incidence angle $\theta_{WI}$ and the outgoing angle $\theta_{WO}$ can be set to a substantially vertical direction (that is, 0 degree) by setting the tilt angles $\theta_{TI}$ and $\theta_{TO}$ to about 80.7 degrees. In this case, the irradiator 10 and the photoreceiver 11 can be placed vertically below the window 46.

Figure 25A:
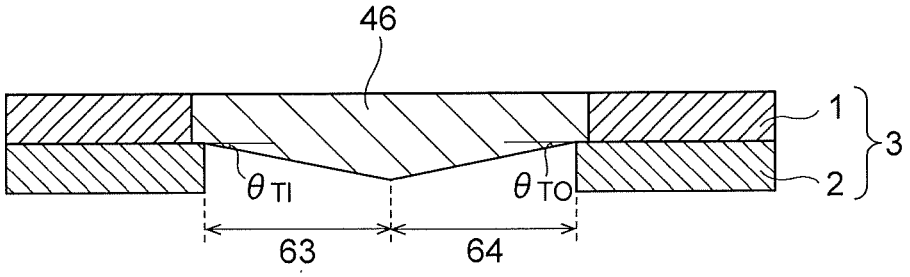
FIGS. 25A and 25B are sectional views illustrating a configuration example of the window according to the eighth embodiment.
Figure 25B:
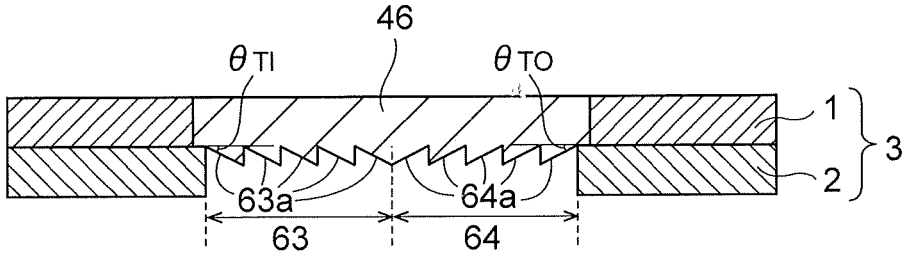

FIGS. 25A and 25B are sectional views illustrating a configuration example of the window 46 according to the eighth embodiment. In the eighth embodiment, there is an opening on a part of the polishing pad 3 and the window 46 is provided at a place corresponding to the polishing layer 1 in the opening. For example, transmissive polyurethane is used as the window 46.

The window 46 illustrated in FIG. 25A includes a first transparent part 63 and a second transparent part 64. The first transparent part 63 transmits the irradiation light $L_I$ to the semiconductor substrate 5 and an incident face on which the irradiation light $L_I$ is incident is tilted to the top surface of the window 46 or the polishing face of the semiconductor substrate 5 in the same manner as the bottom surface 47 illustrated in FIG. 22A. The second transparent part 64 transmits the reflection light $L_R$ from the semiconductor substrate 5 and an outgoing face from which the reflection light $L_R$ is outgoing is tilted to the top surface of the window 46 or the polishing face of the semiconductor substrate 5 in the same manner as the bottom surface 47 illustrated in FIG. 22B. The incident face of the first transparent part 63 and the outgoing face of the second transparent part 64 are tilted in opposite directions to each other. As explained with reference to FIGS. 22A and 22B, the incident face of the first transparent part 63 is tilted to enable the incidence angle $\theta_{WI}$ of the irradiation light $L_I$ to be increased and the outgoing face of the second transparent part 64 is tilted to enable the outgoing angle $\theta_{WO}$ of the reflection light $L_R$ to be increased. The tilt angle $\theta_{TI}$ of the incident face of the first transparent part 63 and the tilt angle $\theta_{TO}$ of the outgoing face of the second transparent part 64 are as described above.

The first transparent part 63 of the window 46 illustrated in FIG. 25B is divided into a plurality of tilted portions 63*a*. The tilt angles of the tilted portions 63*a* are equally $\theta_{TI}$. The second transparent part 64 is also divided into a plurality of tilted portions 64*a*. The tilt angles of the tilted portions 64*a* are equally $\theta_{TO}$. That is, the first transparent part 63 and the second transparent part 64 have Fresnel prism structures, respectively.

The window 46 illustrated in FIG. 25B has an identical effect to that of the window 46 illustrated in FIG. 25A. However, when the tilt angles $\theta_{TI}$ and $\theta_{TO}$ are large, the window 46 in FIG. 25B has an advantage that the thickness of a central portion of the window 46 illustrated in FIG. 25B can be reduced as compared to that of the window 46 illustrated in FIG. 25A. Therefore, in order to increase the tilt angles $\theta_{TI}$ and $\theta_{TO}$ while suppressing the thickness of the window 46, the window 46 having the Fresnel prism structures illustrated in FIG. 25B is preferable.

In the eighth embodiment, tilts are provided integrally with the bottom surface 47 of the window 46. However, the bottom surface 47 of the window 46 may be formed to be substantially parallel to the top surface thereof to attach a separate tilt structure to the bottom surface 47. In this case, the window 46 and the tilt structure (not illustrated) may be formed of different materials.

Ninth Embodiment

Figure 26:
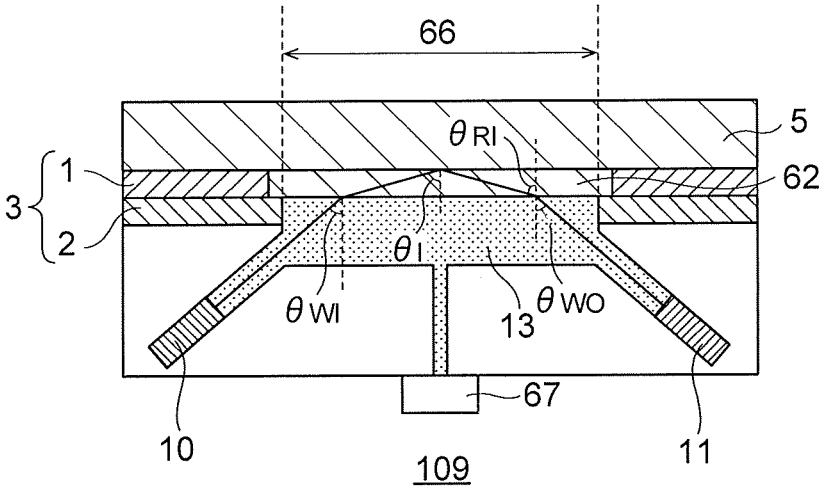
FIG. 26 is a schematic sectional view illustrating a configuration example of a polishing apparatus according to a ninth embodiment.

FIG. 26 is a schematic sectional view illustrating a configuration example of a polishing apparatus according to a ninth embodiment. FIG. 26 illustrates a configuration of an opening 66 and a peripheral part thereof. A polishing apparatus 109 according to the ninth embodiment has a window 62 being a transparent part. The transmissive window 62 is provided at a place corresponding to the polishing layer 1 in the opening 66.

A high-refractive-index liquid supplier 67 is provided in the optical path region 13 under the window 62. The high-refractive-index liquid supplier 67 supplies pure water or a high refractive index liquid having a higher refractive index than pure water to the optical path region 13. Accordingly, the high-refractive-index liquid supplier 67 can fill the optical path region 13 under the window 62 with the pure water or the high refractive index liquid. The pure water or the high refractive index liquid is filled in between the irradiator 10 and the window 62 and between the photoreceiver 11 and the window 62. This suppresses the irradiation light $L_I$ and the reflection light $L_R$ from being refracted by an interface between air having a lower refractive index and a material film.

With supply of the high refractive index liquid to the optical path region 13, the angle $\theta_I$ of incidence of the irradiation light $L_I$ on the semiconductor substrate 5 can be increased and the reflection light is enabled to be outgoing from the bottom surface of the window 62 to reach the photoreceiver 11 even if the tilt angles $\theta_{TI}$ and $\theta_{TO}$ of the bottom surface of the window 62 are 0 degree. Therefore, the interference between the reflection lights from the top surface and the bottom surface of the polishing layer 1 can be sufficiently intensified.

Furthermore, when the high refractive index liquid is supplied to the optical path region 13, the angle $\theta_{WI}$ of the irradiation light $L_I$ with respect to the vertical direction and the angle $\theta_{WO}$ of the reflection light $L_R$ outgoing from the window 62 with respect to the vertical direction can be set to be smaller than the incidence angle $\theta_I$ even if the tilt angles $\theta_{TI}$ and $\theta_{TO}$ of the bottom surface of the window 62 are 0 degree.

The ninth embodiment may be combined with the eighth embodiment. In this case, because the tilt angles $\theta_{TI}$ and $\theta_{TO}$ are set to positive values, the angles $\theta_{WI}$ and $\theta_{WO}$ can be further decreased. Because the thickness of the window 62 is restricted by the thickness of the polishing pad 3, it is preferable that the tilt angles $\theta_{TI}$ and $\theta_{TO}$ be smaller.

The angles $\theta_{WI}$ and $\theta_{WO}$ are represented by expressions 11 and 12. In these expressions, $n_{FILLER}$ is the refractive index of the high refractive index liquid, $n_{WINDOW}$ is the refractive index of the window 62, $\theta_{TI}$ is the tilt angle of the bottom surface of the window 62 on the optical path of the irradiation light $L_I$, and $\theta_{TO}$ is the tilt angle of the bottom surface of the window 62 on the optical path of the reflection light $L_R$.

$$\theta_{WI} = \theta_{TI} + \sin^{-1}\left[\frac{n_{WINDOW}}{n_{FILLER}}\sin\left\{\sin^{-1}\left(\frac{n_{WATER}}{n_{WINDOW}}\sin\theta_I\right) - \theta_{TI}\right\}\right] \quad \text{(expression 11)}$$

$$\theta_{WO} = \theta_{TO} + \sin^{-1}\left[\frac{n_{WINDOW}}{n_{FILLER}}\sin\left\{\sin^{-1}\left(\frac{n_{WATER}}{n_{WINDOW}}\sin\theta_I\right) - \theta_{TO}\right\}\right] \quad \text{(expression 12)}$$

Figure 27:
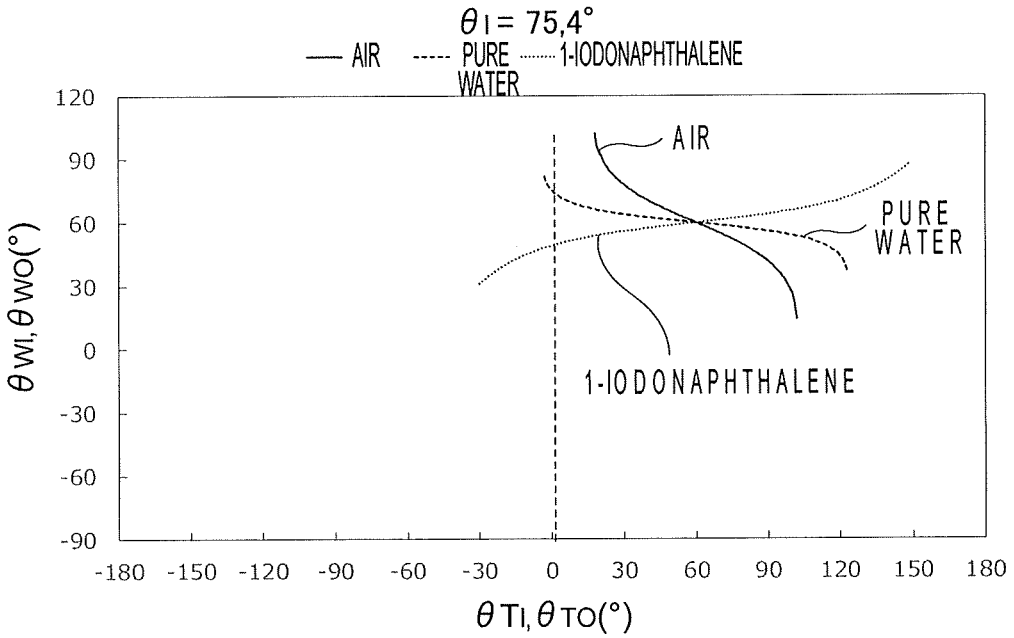
FIG. 27 is a graph illustrating relations between the tilt angles $\theta_{TI}$ and $\theta_{TO}$ of the bottom surface of the window and the angles $\theta_{WI}$ and $\theta_{WO}$.

FIG. 27 is a graph illustrating relations between the tilt angles $\theta_{TI}$ and $\theta_{TO}$ of the bottom surface of the window 62 and the angles $\theta_{WI}$ and $\theta_{WO}$. The window 62 is assumed to be urethane (the refractive index $n_{WINDOW}$=1.490). The incidence angle $\theta_I$ is assumed to be 75.4 degrees.

When a medium filled in the optical path region 13 is air, the tilt angles $\theta_{TI}$ and $\theta_{TO}$ of the bottom surface of the window 62 cannot be set to 0 degree and need to be equal to or larger than about 18 degrees. When a medium filled in the optical path region 13 is pure water, the tilt angles $\theta_{TI}$ and $\theta_{TO}$ of the bottom surface of the window 62 can be set to 0 degree. However, in this case, the angles $\theta_{WI}$ and $\theta_{WO}$ need to be about 75.4 degrees, which is equal to the incidence angle $\theta_I$. When a medium filled in the optical path region 13 is 1-iodonaphthalene (the refractive index $n_{FILLER}$=1.701) as a high refractive index liquid, the tilt angles $\theta_{TI}$ and $\theta_{TO}$ of the bottom surface of the window 62 can be set to about 0 degree and the angles $\theta_{WI}$ and $\theta_{WO}$ can be decreased to, for example, about 49.3 degrees. Due to the filling of the optical path region 13 with a high refractive index liquid in this way, the tilt angles $\theta_{TI}$ and $\theta_{TO}$ can be set to about 0 degree while the bottom surface of the window 62 is not tilted to the polishing face of the semiconductor substrate 5 or the top surface of the window 62.

In the ninth embodiment, the fluid in the optical path region 13 and the slurry on the window 62 are separated by the window 62 and the filling fluid and the slurry are not mixed. Accordingly, influences on the polishing characteristics or changes in the refractive index of the fluid in the optical path region 13 can be suppressed. Furthermore, because the window 62 is provided on the opening 66, the optical path region 13 can be easily filled with a fluid at the time of replacement of the polishing pad 3. Because a fluid is filled in the optical path region 13, vibration or displacement due to contact between the surface of the polishing pad 3 and the semiconductor substrate 5 does not affect the optical path.

Tenth Embodiment

Figure 28:
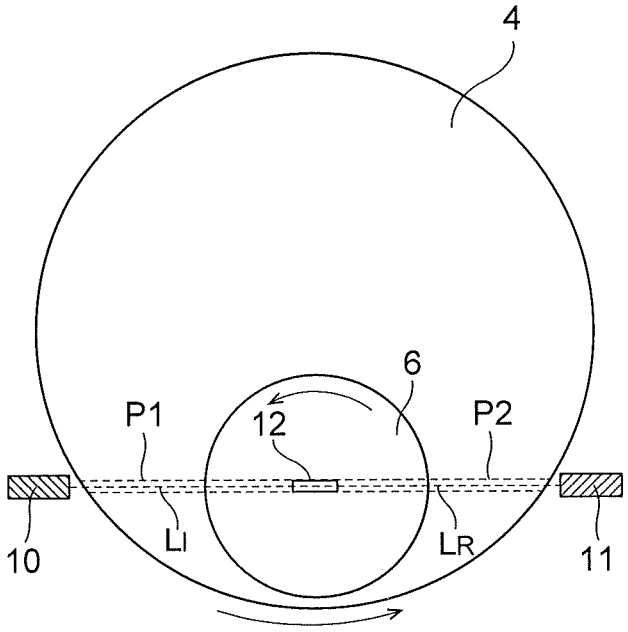
FIGS. 28 and 29 are schematic plan and sectional views illustrating a configuration example of a polishing apparatus according to a tenth embodiment.
Figure 29:
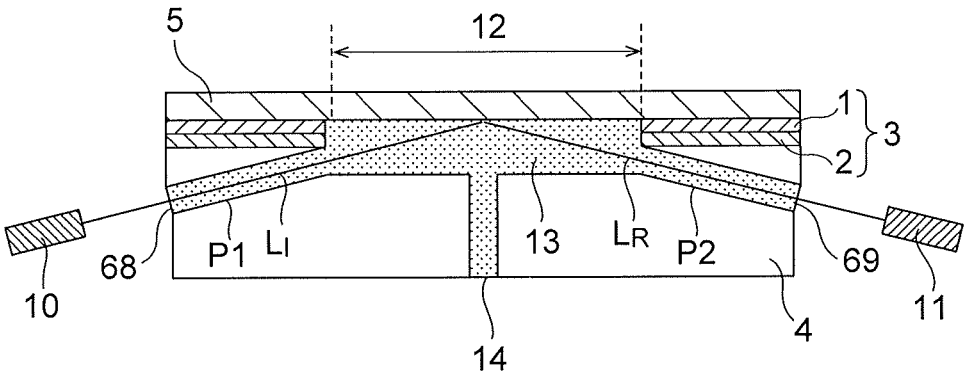

FIGS. 28 and 29 are schematic plan and sectional views illustrating a configuration example of a polishing apparatus according to a tenth embodiment. According to the tenth embodiment, the irradiator 10 and the photoreceiver 11 are provided outside the polishing table 4 and are placed at positions across the polishing head 6. A first optical path P1 that enables the irradiation light $L_I$ to pass through is provided in the polishing table 4 to be communicated with the opening 12 and the optical path region 13. A second optical path P2 that enables the reflection light $L_R$ to pass through is provided in the polishing table 4 to be communicated with the opening 12 and the optical path region 13. Other configurations of the tenth embodiment may be identical to the corresponding ones of the first embodiment.

The irradiator 10 placed outside the polishing table 4 enables the irradiation light $L_I$ to pass through an incident window 68 and the first optical path P1 to irradiate the polishing face of the semiconductor substrate 5 with the irradiation light $L_I$. The reflection light $L_R$ passes through the second optical path P2 and an outgoing window 69 to be received by the photoreceiver 11 installed outside the polishing table 4. The incident window 68 is preferably a face substantially perpendicular to the irradiation light $L_I$ not to refract or reflect the irradiation light $L_I$. The outgoing window 69 is preferably a face substantially perpendicular to the reflection light $L_R$ not to refract or reflect the reflection light $L_R$.

In the tenth embodiment, the irradiator 10 and the photoreceiver 11 are fixedly placed while the polishing table 4 rotates. Accordingly, in order to irradiate the semiconductor substrate 5 with the irradiation light $L_I$ and enable the photoreceiver 11 to receiver the reflection light $L_R$, the polishing table 4, the irradiator 10, and the photoreceiver 11 need to have a placement relation illustrated in FIG. 28. That is, the film thickness of the polishing target (the silicon dioxide film 23) of the semiconductor substrate 5 can be measured only once each time the polishing table 4 rotates one turn.

In the tenth embodiment, the irradiator 10 and the photoreceiver 11 are placed outside the polishing table 4. Accordingly, there is no need to place the irradiator 10 and the photoreceiver 11 on the rotating polishing table 4 and it suffices to provide the optical paths P1 and P2, the optical path region 13, and the like, therein. Therefore, the polishing table 4 can be downscaled and reduced in the weight.

Figure 30:
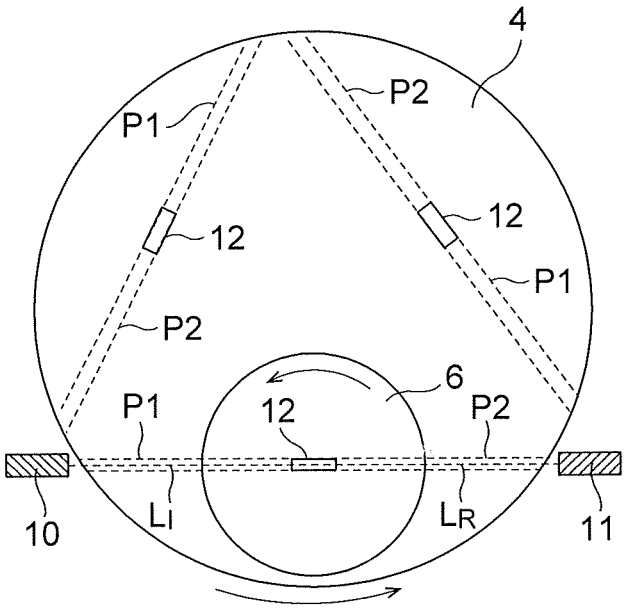
FIG. 30 is a schematic plan view illustrating a configuration example of a polishing apparatus according to a modification of the tenth embodiment.

FIG. 30 is a schematic plan view illustrating a configuration example of a polishing apparatus according to a modification of the tenth embodiment. In the present modification, a plurality of the first optical paths P1, a plurality of the second optical paths P2, and a plurality of the openings 12 are provided in the polishing table 4. The openings 12 are placed substantially evenly at substantially same distances from the rotation center of the polishing table 4. The irradiator 10 and the photoreceiver 11 enable irradiation of the semiconductor substrate 5 with the irradiation light $L_I$ and reception of the reflection light $L_R$ by the photoreceiver 11 through the first optical paths P1, the second optical paths P2, and the openings 12. Accordingly, the film thickness of the polishing target (the silicon dioxide film 23) of the semiconductor substrate 5 can be measured plural times each time the polishing table 4 rotates one turn. That is, the frequency of measurement of the film thickness of the polishing target (the silicon dioxide film 23) of the semiconductor substrate 5 can be increased.

Figure 31:
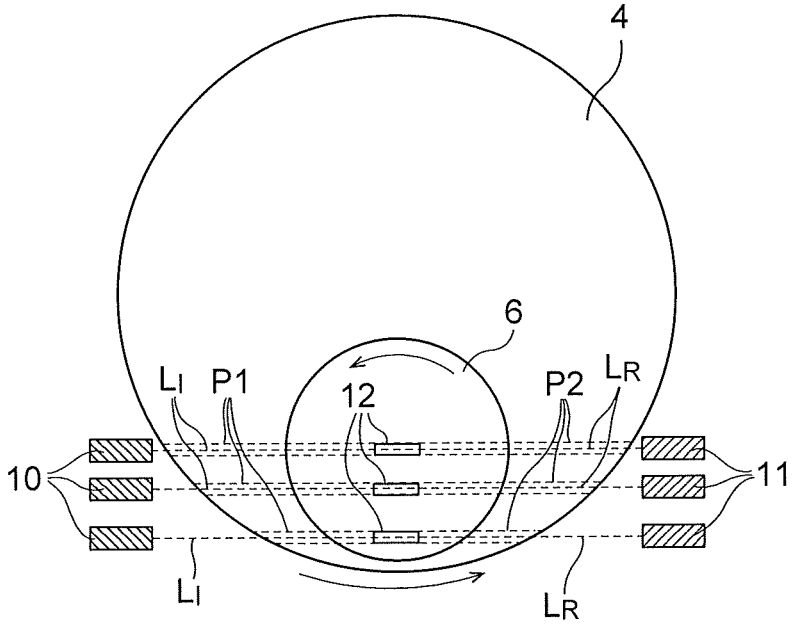
FIG. 31 is a schematic plan view illustrating a configuration example of a polishing apparatus according to another modification of the tenth embodiment.

FIG. 31 is a schematic plan view illustrating a configuration example of a polishing apparatus according to another modification of the tenth embodiment. In the present modification, a plurality of the first optical paths P1, a plurality of the second optical paths P2, and a plurality of the openings 12 are provided to be arrayed in the radial direction of the semiconductor substrate 5. A plurality of the irradiators 10 and a plurality of the photoreceivers 11 are provided to correspond to the first optical paths P1, the second optical paths P2, and the openings 12, respectively. In the present modification, the irradiators 10 and the photoreceiver 11 enable irradiation of the semiconductor substrate 5 with the irradiation lights $L_I$ and reception of the reflection lights $L_R$ by the photoreceivers 11 through the first optical paths P1 and the second optical paths P2, respectively. Accordingly, the irradiators 10 and the photoreceivers 11 can measure the film thickness at different positions in the radial direction of the semiconductor substrate 5. That is, the in-plane distribution of the film thickness of the polishing target (the silicon dioxide film 23) of the semiconductor substrate 5 can be known.

As described above, arrangement of the first optical paths P1, the second optical paths P2, the openings 12, the irradiators 10, and the photoreceivers 11, and the numbers thereof can be freely set. The modification of FIG. 30 and the modification of FIG. 31 may be combined with each other.

Figure 32:
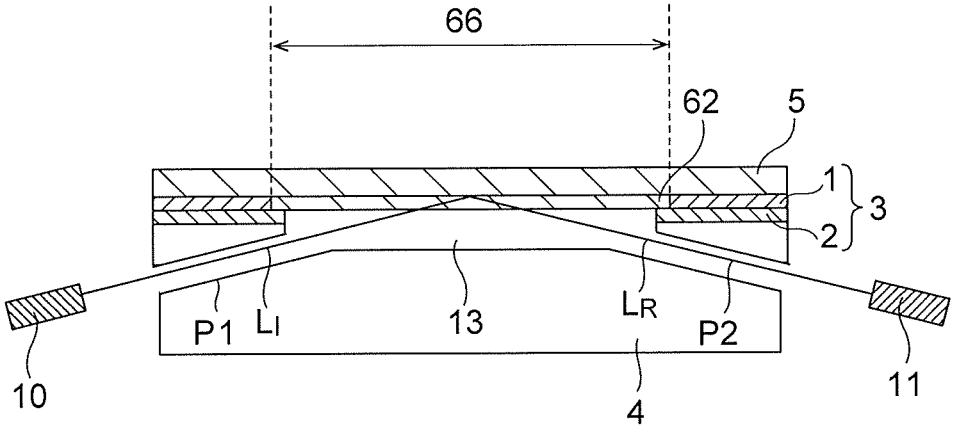
FIG. 32 is a sectional view illustrating a configuration example of a polishing apparatus according to still another modification of the tenth embodiment.

FIG. 32 is a sectional view illustrating a configuration example of a polishing apparatus according to still another modification of the tenth embodiment. In the present modification, the optical path region 13 is open to outside air and there is air in the optical path region 13. The irradiation light $L_I$ and the reflection light $L_R$ are incident and outgoing via the air.

The opening 66 is provided on the polishing pad 3. The transmissive window 62 is provided at a place corresponding to the polishing layer 1 in the opening 66. The window 62 is provided so as to cover the opening 66.

The angles of the irradiator 10, the photoreceiver 11, the first optical path P1, and the second optical path P2 are set to enable the irradiation light $L_I$ to be incident on the polishing face of the semiconductor substrate 5 at a desired incidence angle $\theta_I$ and enable the reflection light $L_R$ to reach the photoreceiver 11 considering refraction on the bottom surface and the top surface of the window 62. When the incidence angle $\theta_I$ is set to an angle above the critical angle from water to air, the bottom surface of the window 62 may be formed to have a tilt structure as in the eighth embodiment.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

(Notes)

A polishing apparatus according to the present embodiment comprises:

a holder configured to hold a polishing target;

a polisher configured to polish the polishing target;

an irradiator configured to irradiate the polishing target with an irradiation light from below the polisher; and a photoreceiver configured to receive a reflection light reflected from the polishing target to detect a relation between a wavelength and a light quantity of the reflection light, wherein the irradiator irradiates the polishing target with the irradiation light in a direction tilted to a polishing face of the polishing target to enable a first light quantity of an S polarized light of a reflection light from a first face of the polishing target and a second light quantity of an S polarized light of a reflection light from a second face of the polishing target on an opposite side to the first face to exceed a third light quantity of S polarized lights of reflection lights from layers lower than the polishing target.

The polishing apparatus further comprises a polarization filter provided at a freely-selected position on an optical path from the irradiator to the photoreceiver and configured to enable S polarized lights to pass through.

The polishing apparatus further comprises a driver configured to change positions of the irradiator and the photoreceiver or tilts thereof to enable the first and second light quantities to exceed the third light quantity.

An angle of incidence of the irradiation light on the polishing target is equal to or larger than 75.4 degrees.

The irradiator irradiates the polishing target with the irradiation light in a direction tilted to the polishing target to set the angle of incidence of the irradiation light on the polishing target to about 75.4 degrees.

A polishing apparatus according to another embodiment comprises:

a holder configured to hold a polishing target;

a polisher configured to polish the polishing target;

an irradiator configured to irradiate the polishing target with an irradiation light from below the polisher; and a photoreceiver configured to receive a reflection light reflected from the polishing target to detect a relation between a wavelength and a light quantity of the reflection light, wherein the polisher is rotatable with respect to the polishing target, the irradiator irradiates the polishing target with the irradiation light in a direction tilted to a polishing face of the polishing target, and either a light source configured to generate the irradiation light or a detector configured to detect the reflection light, or both thereof are provided outside the polisher.

A polishing apparatus comprises:

an irradiator provided on a polisher and configured to irradiate a polishing target with an irradiation light from below the polisher; and a light source provided outside the polisher, connected to the irradiator with an optical rotary joint, and configured to generate the irradiation light.

A polishing apparatus comprises:

a photoreceiver provided on a polisher and configured to receive a reflection light reflected from a polishing target to detect a relation between a wavelength and a light quantity of the reflection light; and a detector provided outside the polisher, connected to the photoreceiver with an optical rotary joint, and configured to detect the reflection light.

A polishing apparatus comprises:

a first optical path provided on a polisher and configured to enable an irradiation light to pass through;

an irradiator provided outside the polisher and configured to irradiate the polishing target with the irradiation light through the first optical path; and a light source provided outside the polisher, connected to the irradiator, and configured to generate the irradiation light.

A polishing apparatus comprises:

a second optical path provided on a polisher and configured to enable an irradiation light to pass through;

a photoreceiver provided outside the polisher and configured to receive a reflection light reflected from a polishing target through the second optical path to detect a relation between a wavelength and a light quantity of the reflection light; and a detector provided outside the polisher, connected to the photoreceiver, and configured to detect the reflection light.

A polishing apparatus according to another embodiment comprises:

a holder configured to hold a polishing target;

a polisher configured to polish the polishing target;

an irradiator configured to irradiate the polishing target with an irradiation light from below the polisher;

a photoreceiver configured to receive a reflection light reflected from the polishing target to detect a relation between a wavelength and a light quantity of the reflection light; and a movement mechanism configured to move the irradiator or the photoreceiver in a substantially vertical direction or a substantially horizontal direction.

The polishing apparatus further comprises a computing part configured to estimate a distance between the irradiator or the photoreceiver and the polishing target or a change amount of the distance and determine movement distances of the irradiator and the photoreceiver on a basis of the distance or the change amount of the distance.

The polishing apparatus further comprises a polishing-pad-thickness measuring part configured to measure a thickness of a polishing pad of the polisher or a change amount of the thickness, and the computing part estimates the distance or the change amount of the distance on a basis of the thickness of the polishing pad or the change amount of the thickness.

The computing part estimates the thickness of the polishing pad or the change amount of the thickness on a basis of a correlation among the number of the polishing targets polished, a use time of the polishing pad, or a dressing time of the polishing pad and the thickness of the polishing pad.

A polishing apparatus according to another embodiment comprises:

a holder configured to hold a polishing target;

a polisher configured to polish the polishing target;

an irradiator configured to irradiate the polishing target with an irradiation light from below the polisher in a direction tilted to a polishing face of the polishing target;

a photoreceiver configured to receive a reflection light reflected from the polishing target to detect a relation between a wavelength and a light quantity of the reflection light;

a transparent part configured to transmit the irradiation light to the polishing target and transmit the reflection light to the photoreceiver; and a high-refractive-index liquid supplier configured to supply water or a high refractive index liquid having a higher refractive index than water to between the irradiator and the transparent part and between the photoreceiver and the transparent part.

A polishing pad according to the present embodiment is a polishing pad polishing a polishing target and comprises:

a first transparent part configured to transmit an irradiation light from below the polishing pad to the polishing target and having an incident face on which the irradiation light is incident tilted to a polishing face of the polishing target; and a second transparent part configured to transmit a reflection light reflected from the polishing target and having an outgoing face from which the reflection light is outgoing tilted to the polishing face of the polishing target.

The incident face of the first transparent part and the outgoing face of the second transparent part are tilted in opposite directions to each other.

A tilt of the incident face of the first transparent part or a tilt of the outgoing face of the second transparent part is divided into a plurality of tilted portions.

The invention claimed is:

1. A polishing apparatus, comprising:

a holder configured to hold a polishing target;

a polisher configured to polish the polishing target;

an irradiator configured to irradiate the polishing target with an irradiation light from below the polisher;

a photoreceiver configured to receive a reflection light reflected from the polishing target to detect a relation between a wavelength and a light quantity of the reflection light;

a first reflector configured to bend the irradiation light from the irradiator in a direction tilted to the polishing target; and a second reflector configured to bend the reflection light from the polishing target to the photoreceiver, wherein the first reflector irradiates the polishing target with the irradiation light in the direction tilted to the polishing target, the first reflector is provided on an upper inner wall of an optical path region filled with pure water and is placed in a vertical direction of the irradiator, the first reflector changes a direction of the irradiation light from the irradiator to change an incidence angle to a desired angle, the second reflector is provided on the upper inner wall of the optical path region and is placed in the vertical direction of the photoreceiver, the second reflector changes a direction of the reflection light from a silicon dioxide film to enable the reflection light to reach the photoreceiver, the first reflector is a mirror or a prism, the second reflector is a mirror or a prism, the irradiator and the photoreceiver are longitudinally placed below the first reflector and the second reflector, respectively, and the incidence angle of the irradiation light on the polishing target is equal to or larger than 75.4 degrees.

2. The apparatus of claim 1, wherein the first reflector irradiates the polishing target with the irradiation light in the direction tilted to the polishing target to enable a first light quantity of an S polarized light of a reflection light from a first face of the polishing target and a second light quantity of an S polarized light of a reflection light from a second face of the polishing target on an opposite side to the first face to exceed a third light quantity of S polarized lights of reflection lights from layers lower than the polishing target.

3. The apparatus of claim 1, further comprising an optical-path change mechanism comprising the first reflector and the second reflector and configured to be movable in a direction substantially perpendicular to a polishing face of the polishing target, wherein the optical-path change mechanism moves in a perpendicular direction to substantially keep a constant distance from the polishing face of the polishing target, and the optical-path change mechanism irradiates the polishing target with the irradiation light via a surface of the optical-path change mechanism.

4. The apparatus of claim 3, wherein the surface of the optical-path change mechanism is pressed against the polishing target during polishing of the polishing target.

5. The apparatus of claim 4, further comprising a fluid supplier configured to supply a fluid below the optical-path change mechanism, wherein the fluid supplier presses the surface of the optical-path change mechanism against the polishing target with a pressure of the fluid during polishing of the polishing target.

6. The apparatus of claim 4, wherein at least one end part of the surface of the optical-path change mechanism is tilted or rounded to be lower than a surface of the polisher when pressed against the polishing target.

7. The apparatus of claim 3, wherein the surface of the optical-path change mechanism is covered with a transmissive resin.

8. The apparatus of claim 3, wherein an opening is provided on at least a part of the surface of the optical-path change mechanism, the polishing target is irradiated with the irradiation light from the first reflector through the opening, and the reflection light reaches the second reflector through the opening.

9. The apparatus of claim 3, wherein an angle of incidence of the irradiation light on the polishing target is changed by replacement of the optical-path change mechanism.

* * * * *